US010524522B2

(12) United States Patent
Clement

(10) Patent No.: US 10,524,522 B2
(45) Date of Patent: Jan. 7, 2020

(54) BODY PROTECTOR

(71) Applicant: D.H. ANDERSON HOLDINGS INC., Ontario (CA)

(72) Inventor: Leonard Clement, King (CA)

(73) Assignee: D.H. ANDERSON HOLDINGS INC., Ontario (CA)

( * ) Notice: Subject to any disclaimer, the term of this patent is extended or adjusted under 35 U.S.C. 154(b) by 451 days.

(21) Appl. No.: 14/785,909

(22) PCT Filed: Apr. 22, 2014

(86) PCT No.: PCT/US2014/035048
§ 371 (c)(1),
(2) Date: Oct. 21, 2015

(87) PCT Pub. No.: WO2014/176288
PCT Pub. Date: Oct. 30, 2014

(65) Prior Publication Data

US 2016/0066630 A1 Mar. 10, 2016

Related U.S. Application Data

(60) Provisional application No. 61/814,519, filed on Apr. 22, 2013.

(51) Int. Cl.
*A41D 13/00* (2006.01)
*A41D 13/05* (2006.01)
(Continued)

(52) U.S. Cl.
CPC ..... *A41D 13/0518* (2013.01); *A41D 13/0005* (2013.01); *A41D 13/015* (2013.01);
(Continued)

(58) Field of Classification Search
CPC ..... A41D 13/0518; A41D 13/0005; A41D 31/0061; A41D 31/005; A41D 13/015; A41D 13/05; F41H 1/00; A63B 2071/1208
See application file for complete search history.

(56) References Cited

U.S. PATENT DOCUMENTS 3,640,831 A * 2/1972 Gardner ..... A63B 71/081 428/475.5
4,568,585 A * 2/1986 Kohn ..... B32B 3/16 156/258

(Continued)

OTHER PUBLICATIONS

International Search Report, issued in PCT/US2014/035048, dated Oct. 2, 2014.

*Primary Examiner* — Khaled Annis
(74) *Attorney, Agent, or Firm* — Birch, Stewart, Kolasch & Birch, LLP

(57) ABSTRACT

A body protector includes a plurality of outer left and right front side pad members with a flexible break being formed between adjacent outer left and right front side pad members. A plurality of inner left and right front side pad members is disposed behind said plurality of outer left and right front side pad members for overlapping the respective flexible breaks formed in the plurality of outer left and right front side pad members. A plurality of outer left and right rear side pad members is provided with a flexible break being formed between adjacent outer left and right rear side pad members and a plurality of inner left and right rear side pad members is disposed behind said plurality of outer left rear side pad members for overlapping the respective flexible breaks formed in the plurality of outer left and right rear side pad members.

20 Claims, 21 Drawing Sheets

(51) Int. Cl.

| | |
|---|---|
| ***F41H 1/00*** | (2006.01) |
| ***A41D 13/015*** | (2006.01) |
| ***A41D 31/24*** | (2019.01) |
| ***A41D 31/28*** | (2019.01) |
| *A63B 71/12* | (2006.01) |

(52) U.S. Cl.
CPC ..... *A41D 31/245* (2019.02); *A41D 31/285* (2019.02); *F41H 1/00* (2013.01); *A41D 13/05* (2013.01); *A63B 2071/1208* (2013.01)

(56) References Cited

U.S. PATENT DOCUMENTS

| | | | | | |
|---|---|---|---|---|---|
| 4,884,295 | A * | 12/1989 | Cox | A41D 13/0153 | 2/2.5 |
| 5,007,108 | A | 4/1991 | Laberge et al. | | |
| 5,065,457 | A | 11/1991 | Henson | | |
| 5,465,423 | A * | 11/1995 | Taylor-Varney | A41D 13/0153 | 2/44 |
| 5,465,424 | A | 11/1995 | Cudney et al. | | |
| 6,408,440 | B1 | 6/2002 | Phillips | | |
| 6,510,559 | B1 * | 1/2003 | Linares | A61F 5/03 | 2/462 |
| 7,900,283 | B1 * | 3/2011 | Chen | A41D 13/0518 | 2/267 |
| 2001/0050492 | A1 * | 12/2001 | Janevski | A41D 27/02 | 296/39.1 |
| 2008/0040840 | A1 | 2/2008 | Morrow et al. | | |
| 2015/0164154 | A1 * | 6/2015 | Bencini | A41D 13/015 | 2/455 |

* cited by examiner

BODY PROTECTOR

CROSS-REFERENCE TO RELATED APPLICATIONS

This application is the National Phase of PCT International Application No. PCT/US2014/035048, filed on Apr. 22, 2014, which claims priority under 35 U.S.C. 119(e) to U.S. Provisional Application No. 61/814,519, filed on Apr. 22, 2013, all of which are hereby expressly incorporated by reference into the present application.

BACKGROUND OF THE INVENTION

Field of the Invention

The present invention is directed to a body protector with inner and outer pad members arranged in an overlapping arrangement on the front and rear sides of the body protector.

SUMMARY AND OBJECTS OF THE INVENTION

It is an object of an embodiment of the present invention to provide a body protector including a plurality of outer left and right front side pad members with a flexible break being formed between adjacent outer left and right front side pad members. A plurality of inner left and right front side pad members is disposed behind said plurality of outer left and right front side pad members for overlapping the respective flexible breaks formed in the plurality of outer left and right front side pad members. In addition, a plurality of outer left and right rear side pad members is provided with a flexible break being formed between adjacent outer left and right rear side pad members. A plurality of inner left and right rear side pad members is disposed behind said plurality of outer left rear side pad members for overlapping the respective flexible breaks formed in the plurality of outer left and right rear side pad members.

According to an embodiment of the present invention, each of the plurality of outer and inner, left and right, front and rear side pad members is formed of a foam material.

According to an embodiment of the present invention, the plurality of outer left and right front pad members is arranged at an incline relative to each other and said plurality of inner left and right inner front pad members is arranged at substantially the same incline relative to each other with said plurality of inner left and right front pad members being displaced a predetermined distance relative to the plurality of outer left and right front pad members to enable an overlapping of the foam material forming the plurality of inner left and right front pad members with the flexible break formed between adjacent pad members of respective outer left and right front pad members for eliminating penetration through the flexible break.

According to an embodiment of the present invention, the plurality of outer left and right rear pad members is arranged at an incline relative to each other and said plurality of inner left and right inner rear pad members is arranged at substantially the same incline relative to each other with said plurality of inner left and right rear pad members being displaced a predetermined distance relative to the plurality of outer left and right rear pad members to enable an overlapping of the foam material forming the plurality of inner left and right rear pad members with the flexible break formed between adjacent pad members of respective outer left and right rear pad members for eliminating penetration through the flexible break.

According to an embodiment of the present invention, the plurality of outer left and right front pad members is arranged to be substantially horizontal relative to each other and said plurality of inner left and right inner front pad members is arranged to be substantially horizontal relative to each other with said plurality of inner left and right front pad members being displaced a predetermined distance relative to the plurality of outer left and right front pad members to enable an overlapping of the foam material forming the plurality of inner left and right front pad members with the flexible break formed between adjacent pad members of respective outer left and right front pad members for eliminating penetration through the flexible break.

According to an embodiment of the present invention, the plurality of outer left and right rear pad members is arranged to be substantially horizontal relative to each other and said plurality of inner left and right inner rear pad members is arranged to be substantially horizontal relative to each other with said plurality of inner left and right rear pad members being displaced a predetermined distance relative to the plurality of outer left and right rear pad members to enable an overlapping of the foam material forming the plurality of inner left and right rear pad members with the flexible break formed between adjacent pad members of respective outer left and right rear pad members for eliminating penetration through the flexible break.

According to an embodiment of the present invention, the plurality of outer left and right front pad members is arranged to be substantially vertical relative to each other and said plurality of inner left and right inner front pad members is arranged to be substantially vertical relative to each other with said plurality of inner left and right front pad members being displaced a predetermined distance relative to the plurality of outer left and right front pad members to enable an overlapping of the foam material forming the plurality of inner left and right front pad members with the flexible break formed between adjacent pad members of respective outer left and right front pad members for eliminating penetration through the flexible break.

According to an embodiment of the present invention, the plurality of outer left and right rear pad members is arranged to be substantially vertical relative to each other and said plurality of inner left and right inner rear pad members is arranged to be substantially vertical relative to each other with said plurality of inner left and right rear pad members being displaced a predetermined distance relative to the plurality of outer left and right rear pad members to enable an overlapping of the foam material forming the plurality of inner left and right rear pad members with the flexible break formed between adjacent pad members of respective outer left and right rear pad members for eliminating penetration through the flexible break.

According to an embodiment of the present invention, an attaching member is provided for releasably securing the plurality of left front outer and inner side pad members to said plurality of right front outer and inner side pad members.

According to an embodiment of the present invention, an adjustable left securing member is secured to an outer side of the plurality of outer and inner left front side pad members and an outer side of the plurality of outer and inner left rear side pad members and an adjustable right securing member secured to an outer side of the plurality of outer and inner right front side pad members and an outer side of the plurality of outer and inner right rear side pad members for adjustably securing the plurality of left and right, front and rear, outer and inner side pad members relative to each other.

According to another embodiment of the present invention, a body protector includes a plurality of outer left and right front side pad members with a flexible break being formed between adjacent outer left and right front side pad members. A plurality of inner left and right front side pad members is disposed behind said plurality of outer left and right front side pad members for overlapping the respective flexible breaks formed in the plurality of outer left and right front side pad members. In addition, a plurality of outer left and right rear side pad members is provided with a flexible break being formed between adjacent outer left and right rear side pad members. A plurality of inner left and right rear side pad members is disposed behind said plurality of outer left rear side pad members for overlapping the respective flexible breaks formed in the plurality of outer left and right rear side pad members. A torsion-flex spinal pad extends from an upper portion adjacent to a neck of a user to a lower portion of the body protector with the plurality of outer and inner left rear side pad members being secured to a left side of the torsion-flex spinal pad and the plurality of inner and outer right rear side pad members being secured to a right side of the torsion-flex spinal pad.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
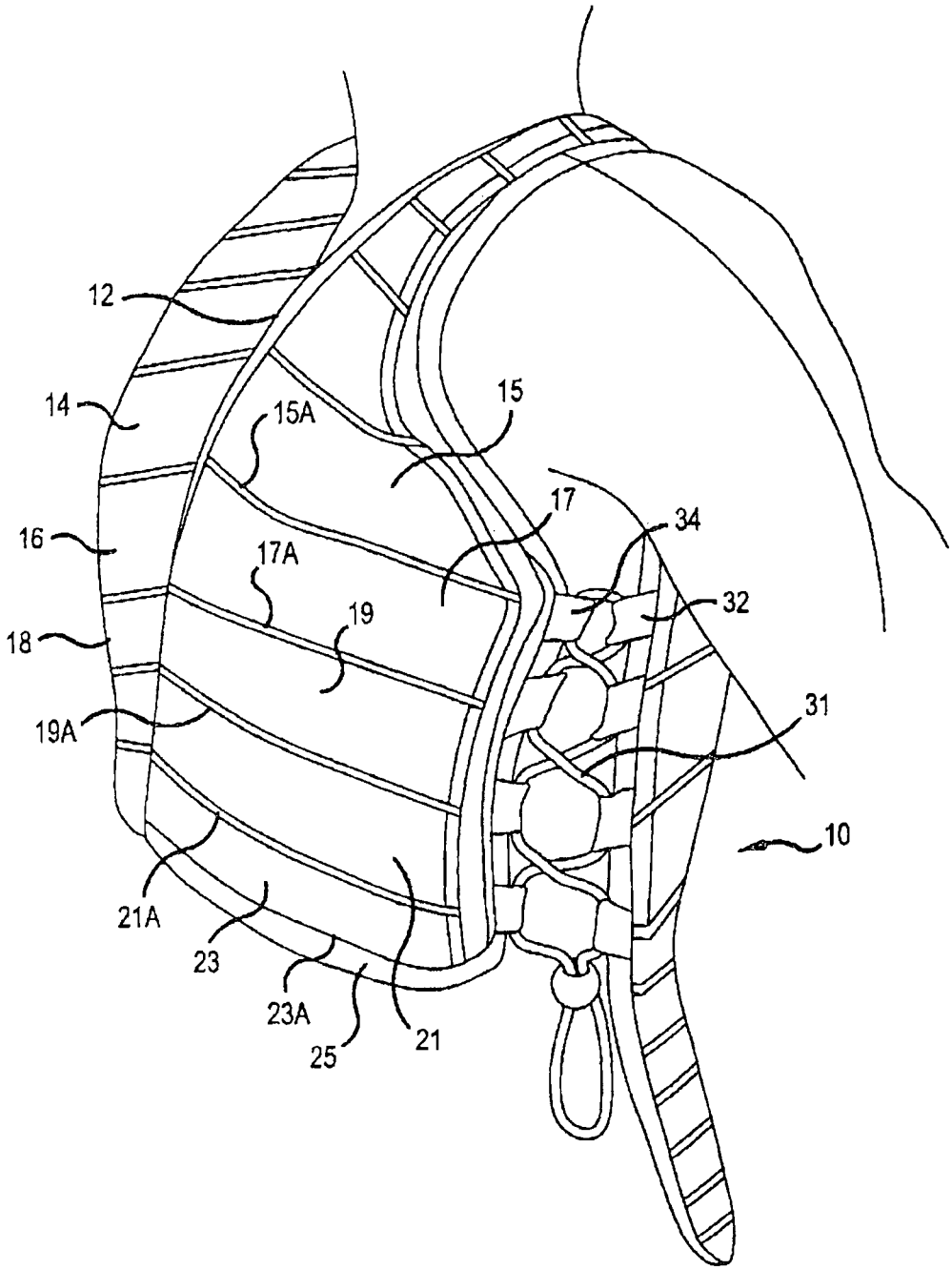
FIG. 1 is a front right perspective view illustrating a plurality of outer left and right front side pad members with a flexible break being formed between adjacent outer left and right front side pad members.
Figure 2:
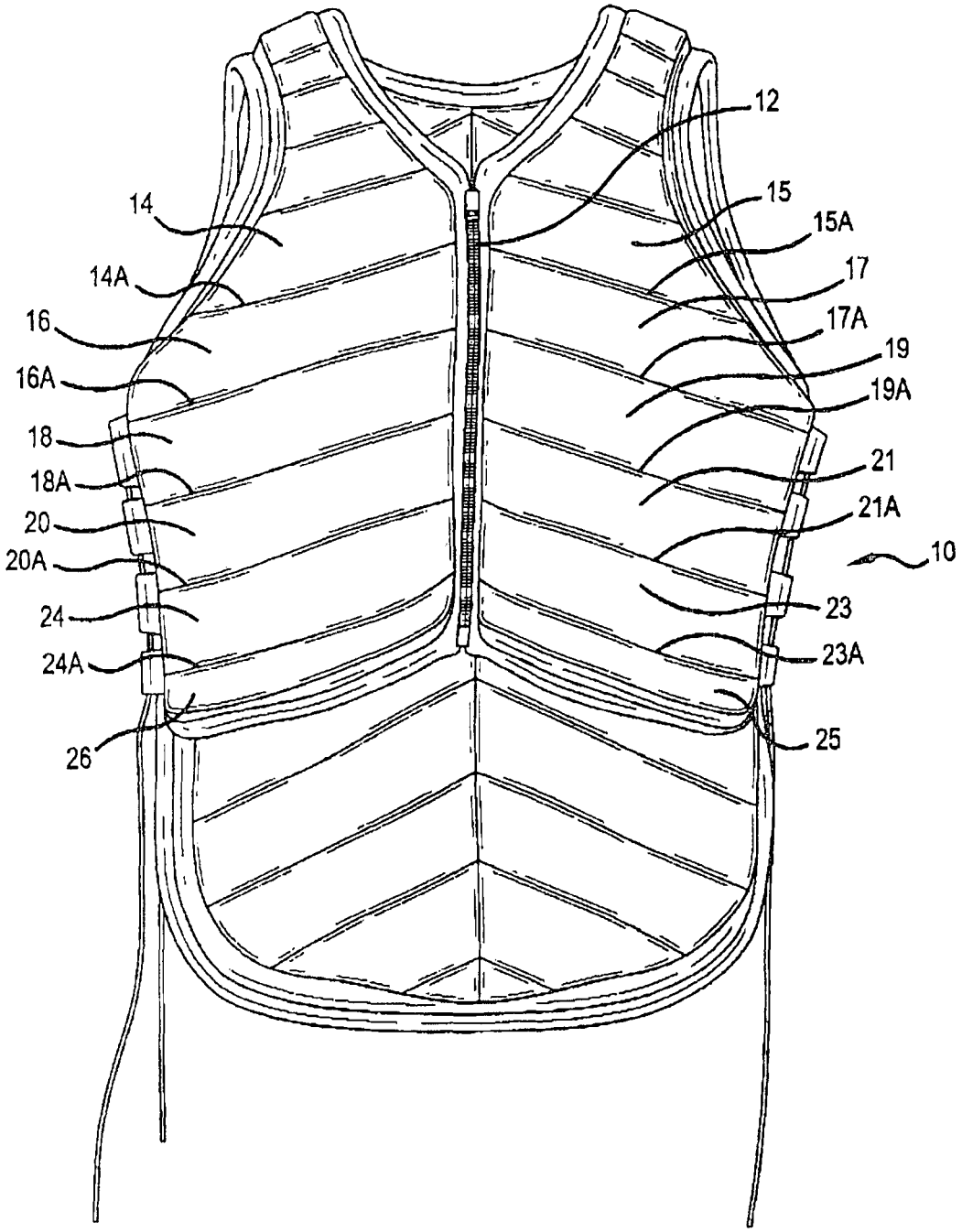
FIG. 2 is a front elevational view illustrating the body protector according to the present invention.

As illustrated in FIGS. 1 and 2, a body protector 10 includes a plurality of outer left front side pad members 14-26 with flexible breaks 14A-24A being formed between adjacent outer left front side pad members 14-26. A plurality of inner left front side pad members is disposed behind said plurality of outer left front side pad members 14-26 for overlapping the respective flexible breaks 14A-24A formed in the plurality of outer left front side pad members 14-26 for eliminating penetration through the flexible breaks 14A-24A.

A plurality of outer right front side pad members 15-25 is provided with a flexible break 15A-23A formed between adjacent outer right front side pad members 15-25. A plurality of inner right front side pad members is disposed behind said plurality of outer right front side pad members 15-25 for overlapping the respective flexible breaks 15A-23A formed in the plurality of outer right front side pad members 15-25 for eliminating penetration through the flexible breaks 15A-23A.

Figure 3:
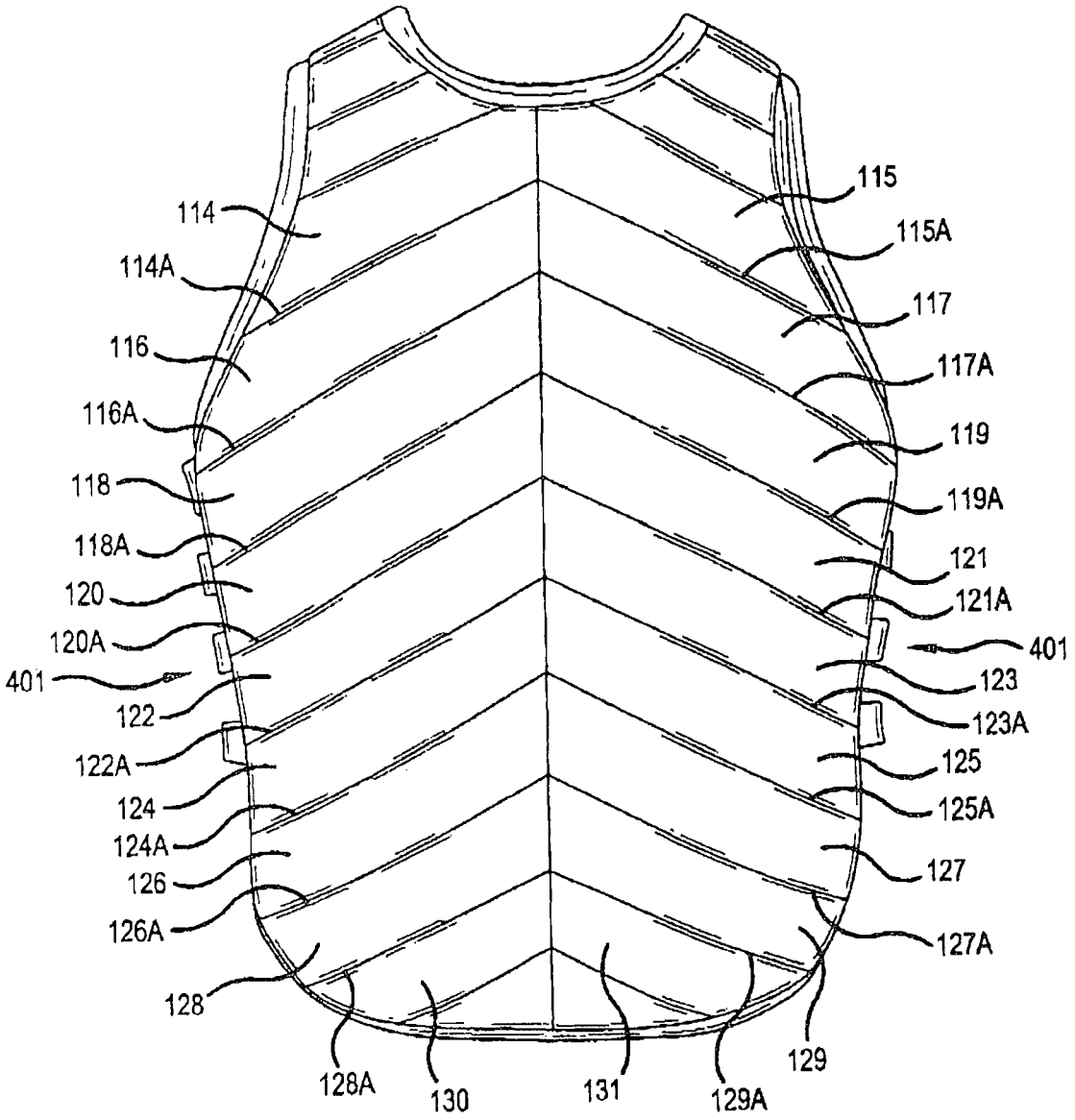
FIG. 3 is a rear elevational view illustrating the body protector according to the present invention.

As illustrated in FIG. 3, a plurality of outer left rear side pad members 114-130 is provided with flexible breaks 114A-128A being formed between adjacent outer left rear side pad members 114-130. A plurality of inner left rear side pad members is disposed behind said plurality of outer left rear side pad members 114-130 for overlapping the respective flexible breaks 114A-128A formed in the plurality of outer left rear side pad members 114-130 for eliminating penetration through the flexible breaks 114A-128A.

As illustrated in FIG. 3, a plurality of outer right rear side pad members 115-131 is provided with a flexible break 115A-129A being formed between adjacent outer right rear side pad members 115-131. A plurality of inner right rear side pad members is disposed behind said plurality of outer right rear side pad members 115-131 for overlapping the respective flexible breaks 115A-129A formed in the plurality of outer right rear side pad members 115-130 for eliminating penetration through the flexible breaks 115A-129A.

Figure 5:
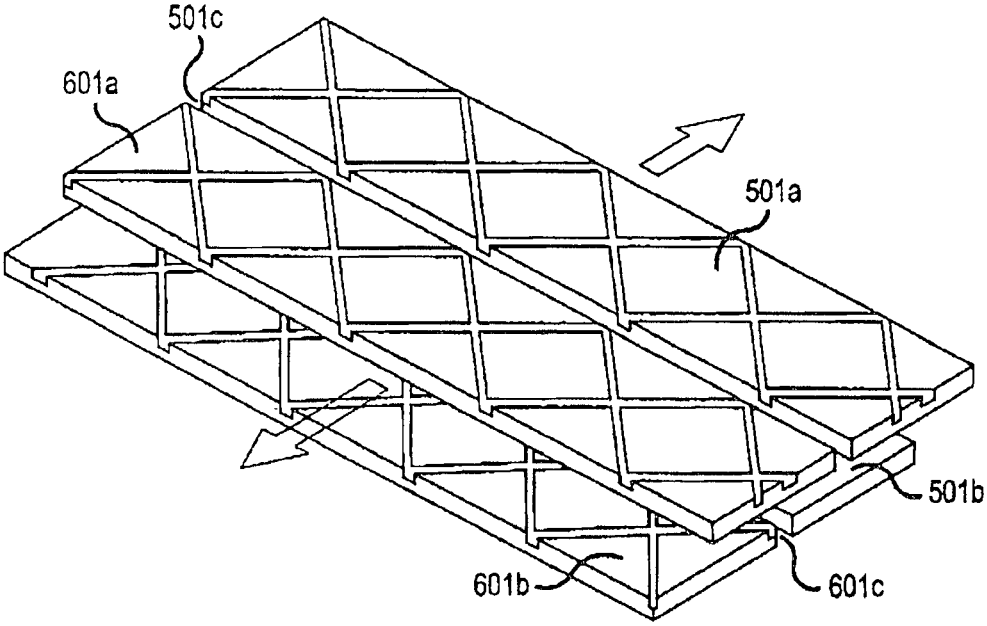
FIG. 5 is a view illustrating the layering of outer and inner side pad members according to an embodiment wherein the pad members include a crisscross slit arrangement on an outer surface thereof.
Figure 6:
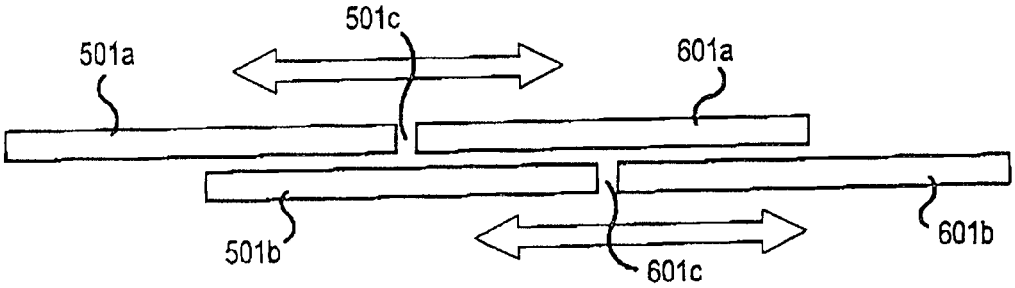
FIG. 6 is a schematic cross-sectional view illustrating the layering of outer and inner side pad members.

As illustrated in FIGS. 5 and 6, each of the plurality of outer and inner, left and right, front and rear side pad members is formed of a foam material 501*a*, 501*b*, 601*a*, 602*a* that is arranged to overlap with each other with flexible breaks 501*c*, 601*c* being formed between the adjacent foam material 501*a* and 601*a* and 501*b* and 601*b*. The inner layer 501*a*, 601*a* is offset a predetermined distance relative to the outer layer 501*b*, 601*b* for eliminating penetration through the flexible breaks 501*c*, 601*c* in view of the positioning of the offset material 601*a* relative to 501*b* and 601*b*. The pad members are not connected, having side edges which are spaced from one another. Therefore, adjacent foam members 501*a*, 601*a* are movable relative to each other, as depicted by the arrows in FIGS. 5 and 6.

As illustrated in FIGS. 1 and 2, the plurality of outer left and right front pad members 14-26 and 15-25 is arranged at an incline relative to each other. The plurality of inner left and right inner front pad members is arranged at substantially the same incline relative to each other. The plurality of inner left and right front pad members is displaced a predetermined distance, as schematically illustrated in FIGS. 5 and 6, relative to the plurality of outer left and right front pad members 14-26 and 15-25 to enable an overlapping of the foam material forming the plurality of inner left and right front pad members with the flexible breaks 14A-24A and 15A-23A formed between adjacent pad members of respective outer left and right front pad members for eliminating penetration through the flexible breaks 14A-24A and 15A-23A.

As illustrated in FIG. 3, the plurality of outer left and right rear pad members 114-128 and 115-129 is arranged at an incline relative to each other. The plurality of inner left and right inner rear pad members is arranged at substantially the same incline relative to each other. The plurality of inner left and right rear pad members is displaced a predetermined distance, as schematically illustrated in FIGS. 5 and 6, relative to the plurality of outer left and right rear pad members 114-128 and 115-129 to enable an overlapping of the foam material forming the plurality of inner left and right rear pad members with the flexible breaks 114A-128A and 115A-129A formed between adjacent pad members of respective outer left and right rear pad members 114-128 and 115-129 for eliminating penetration through the flexible breaks 114A-128A and 115A-129A.

In another embodiment of the present invention, the plurality of outer left and right front pad members 14-26 and 15-25 may be arranged to be substantially horizontal relative to each other. The plurality of inner left and right inner front pad members is arranged to be substantially horizontal relative to each other with said plurality of inner left and right front pad members being displaced a predetermined distance relative to the plurality of outer left and right front pad members 14-26 and 15-25 to enable an overlapping of the foam material forming the plurality of inner left and right front pad members with the flexible break formed between adjacent pad members of respective outer left and right front pad members for eliminating penetration through the flexible break.

According to another embodiment of the present invention, the plurality of outer left and right rear pad members 14-26 and 15-25 may be arranged to be substantially horizontal relative to each other and said plurality of inner left and right inner rear pad members is arranged to be substantially horizontal relative to each other with said plurality of inner left and right rear pad members being displaced a predetermined distance relative to the plurality of outer left and right rear pad members to enable an overlapping of the foam material forming the plurality of inner left and right rear pad members with the flexible break formed between adjacent pad members of respective outer left and right rear pad members for eliminating penetration through the flexible break.

As illustrated in FIG. 1, an attaching member 12 is provided for releasably securing the plurality of left front outer 14-26 and inner side pad members to the plurality of right front outer 15-25 and inner side pad members. The attachment member for the body protector 10 may be a zipper 12.

Figure 4:
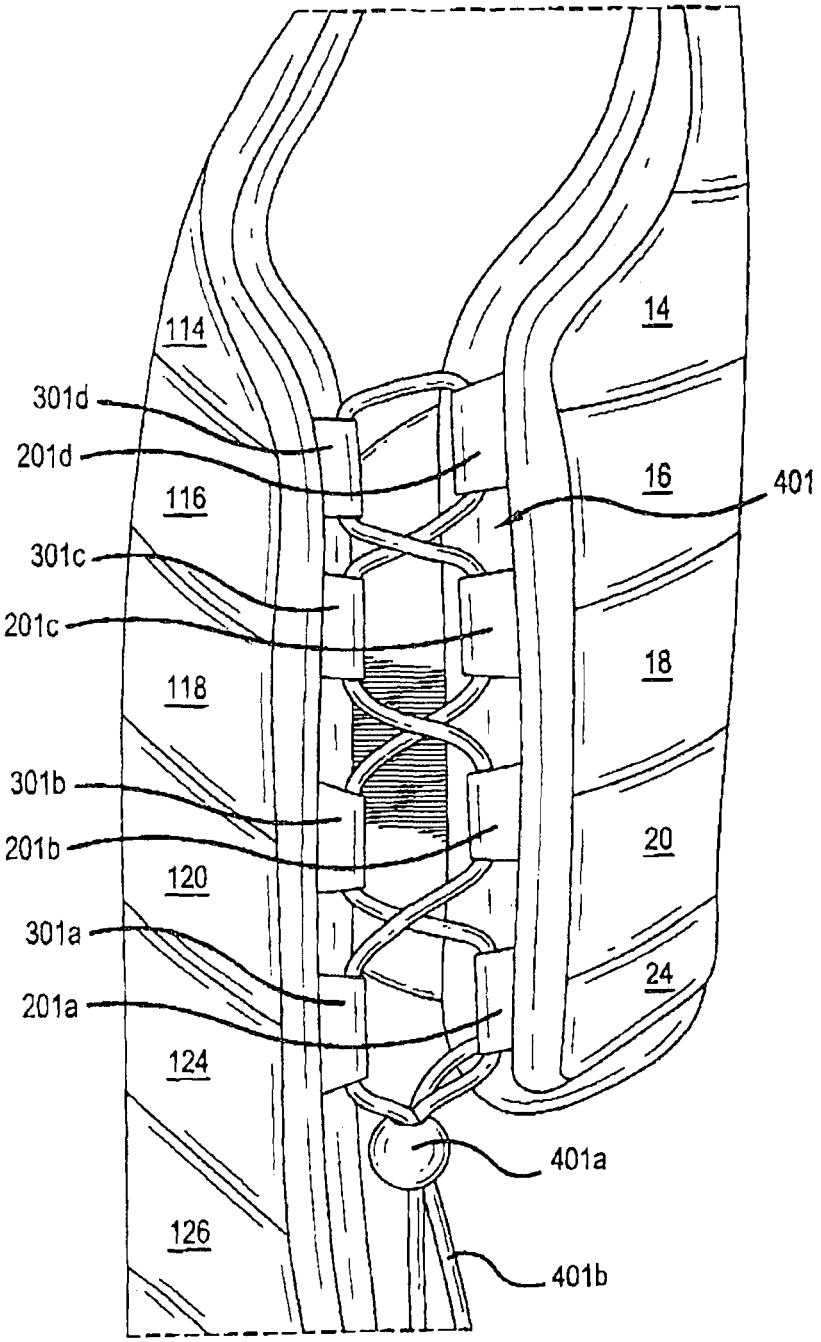
FIG. 4 is a rear right perspective view illustrating the body protector according to the present invention with the live-fit adjustment securing member for attaching the side portions of the body protector.

FIG. 4 is a rear right perspective view illustrating the body protector 10. A live-fit adjustment system or adjustable left securing member 401 may consist of a rope 401*b* adjusted by the retainer 401*a* and positioned between the fasteners 201*a*, 201*b*, 201*c* and 201*d* and the fasteners 301*a*, 301*b*, 301*c* and 301*d* for attaching the side portions of the body protector 10.

As illustrated in FIG. 4, the adjustable left securing member 401 is secured to an outer side of the plurality of outer and inner left front side pad members 14-26 and an outer side of the plurality of outer and inner left rear side pad members 114-130. As illustrated in FIG. 2, an adjustable right securing member 401 is secured to an outer side of the plurality of outer and inner right front side pad members 15-25 and an outer side of the plurality of outer and inner right rear side pad members 115-131 for adjustably securing the plurality of left and right, front and rear, outer and inner side pad members relative to each other.

The live-fit adjustment system or adjustable securing member 401 on each side of the body protector supplies a living adjustment system that moves and provides flex with the individual's body.

Figure 7:
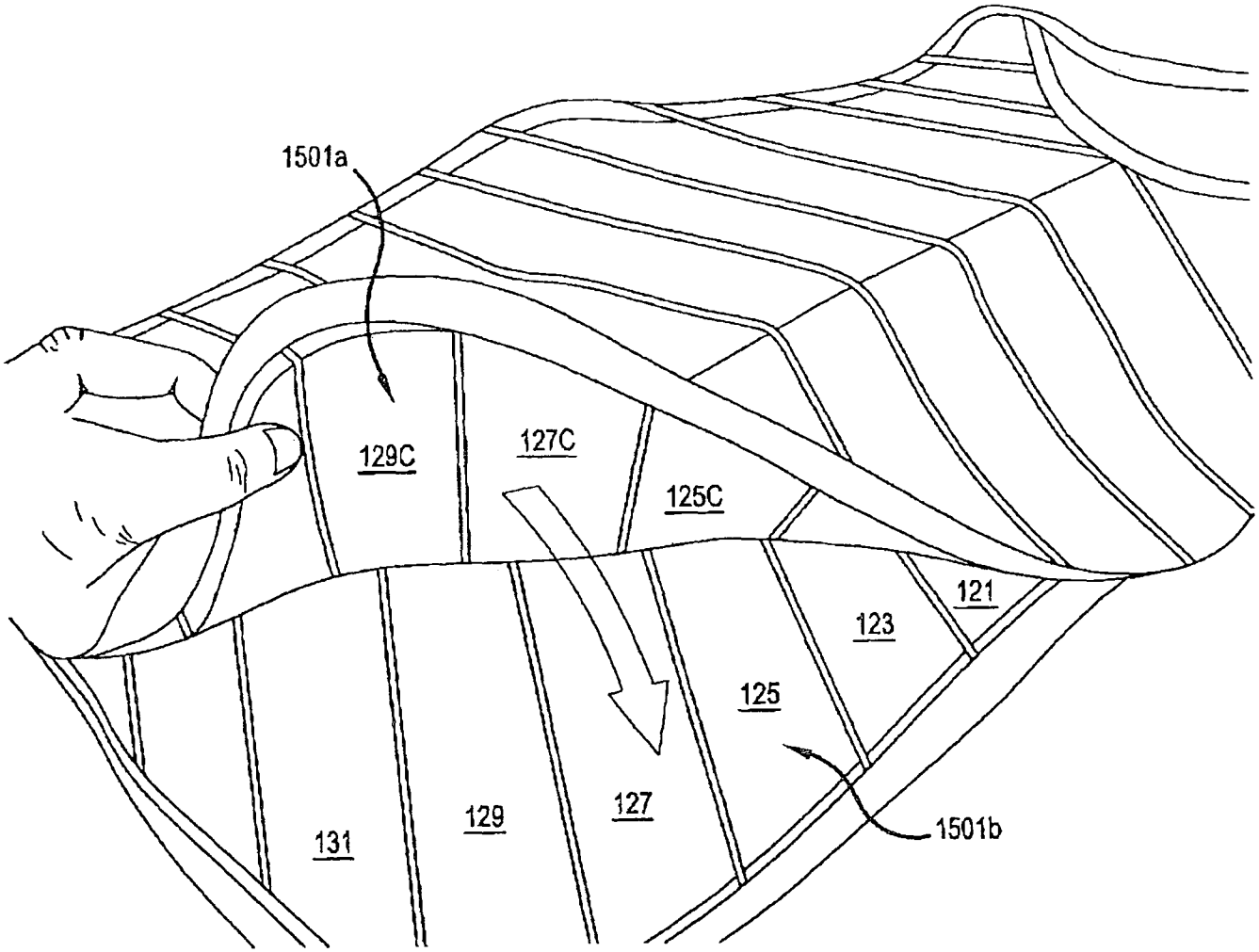
FIG. 7 is a view illustrating the inner rear side pad members and outer rear side pad members of the body protector to show the overlap of the flexible break formed between adjacent inner and outer rear side pad members.

FIG. 7 is a view illustrating the inside back of the body protector 10 that includes an inner shell 1501*a* and an outer shell 1501*b*. The plurality of inner side pad members 125*c*-129*c* is offset a predetermined distance relative to the outer side pad members 121-131. The inner shell 1501*a* and the outer shell 1501*b* may move relative to each other during use by a rider.

Figure 8:
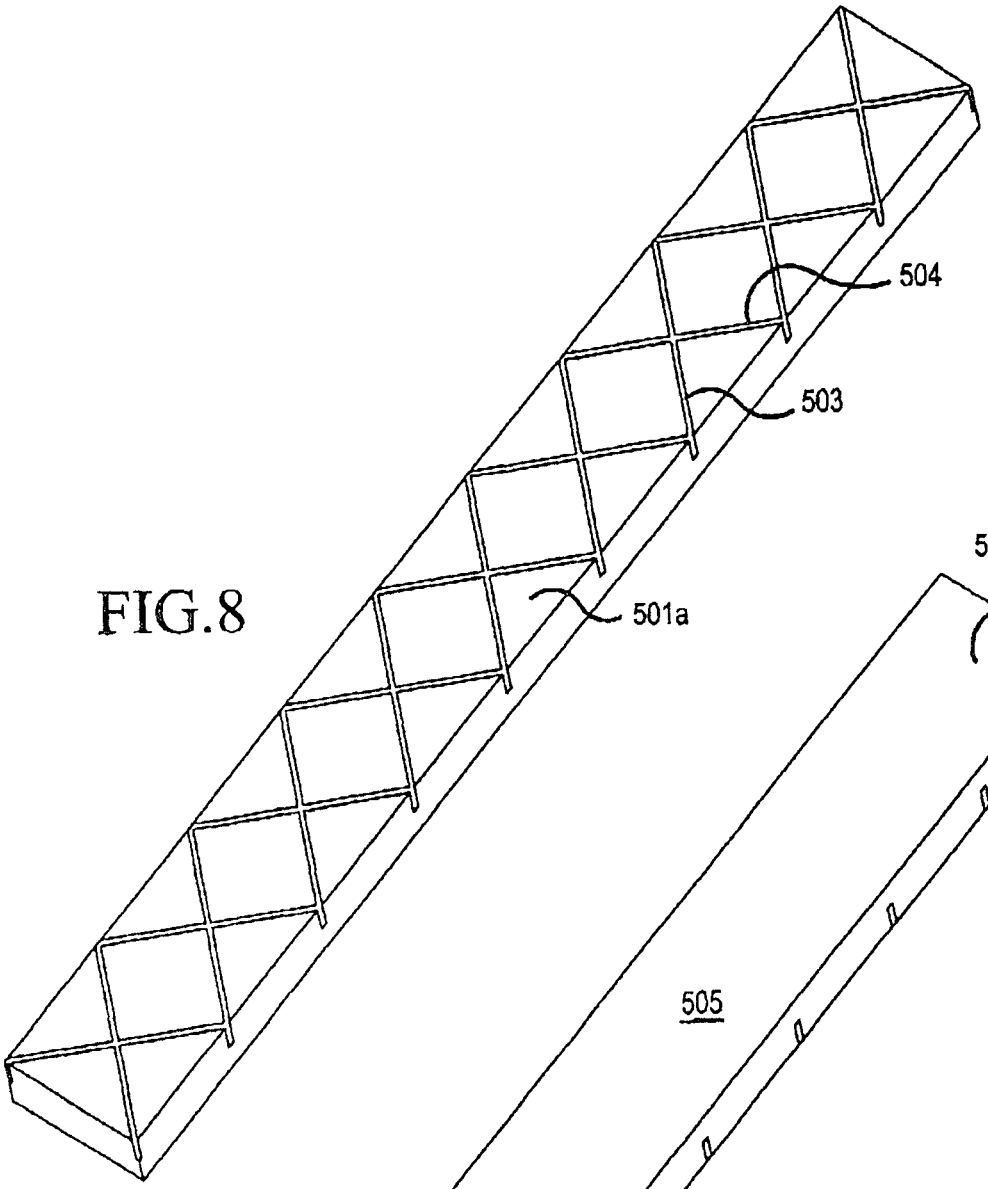
FIG. 8 is a view illustrating one side of one embodiment of a side pad member used within the outer and inner side pad members.

FIG. 8 is an embodiment of the present invention illustrating one side of one embodiment of the pad 105*a* with a plurality of diagonal grooves 503 and 504 extending across a width of the foam member and arranged in a crisscross arrangement. The reverse side may have a flat surface. The pad 501 and a may be used as the left or right, front or rear, outer or in your pad member of the body protector 10.

Figure 9:
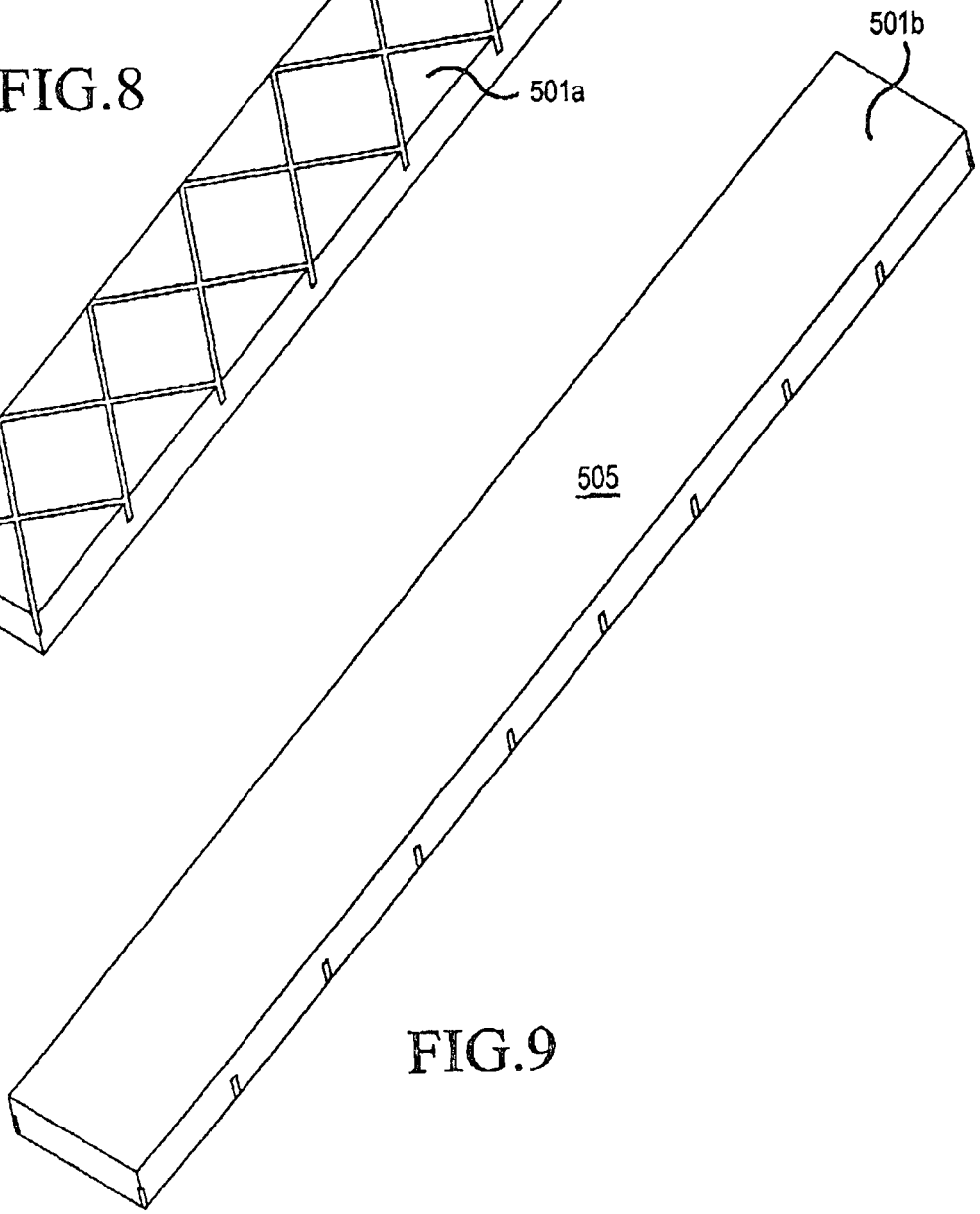
FIG. 9 is a view illustrating the other side of one embodiment of a side pad member used within the outer and inner side pad members.

FIG. 9 is a view illustrating the other side of one embodiment of a pad 501*b* with a flat surface 505 on one side thereof. The reverse side may have a crisscross groove arrangement. The pad 501*b* may be used as the left or right, front or rear, outer or inner pad member of the body protector 10.

Figure 10:
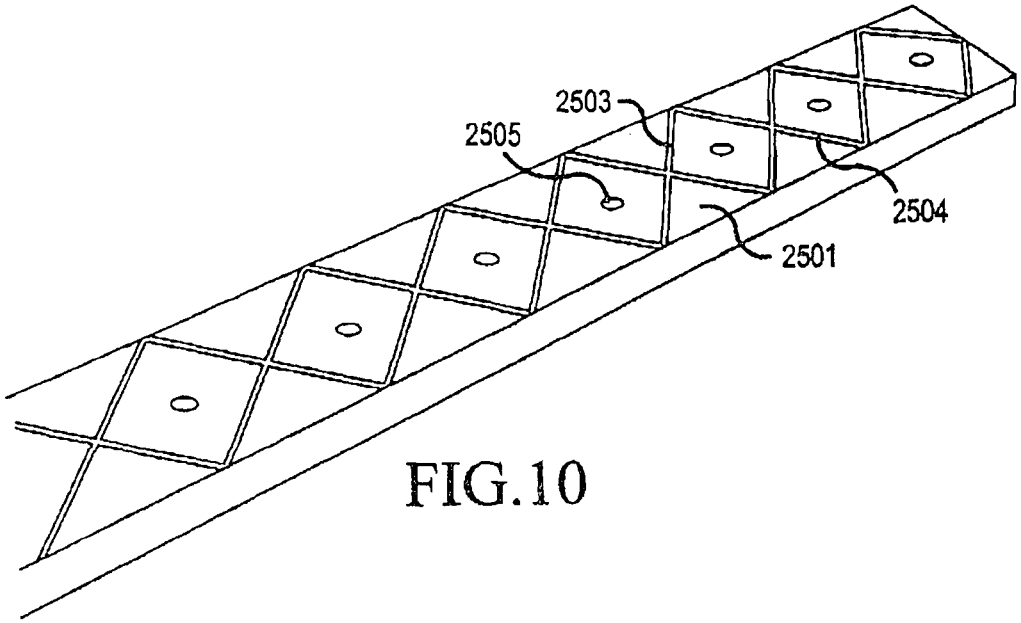
FIG. 10 is a view illustrating one side of a second embodiment of a side pad member used within the inner and outer shells.

FIG. 10 is a view illustrating one side of the second embodiment of the pad 2501 with a plurality of diagonal grooves 2503 and 2504 extending across a width of the foam member and arranged in a crisscross arrangement. The reverse side may have a flat surface. The pad 2501 includes a plurality of apertures 2505 positioned between edges of the foam members and within each of the crisscross arrangement. The pad 2501 and a may be used as the left or right, front or rear, outer or in your pad member of the body protector 10.

Figure 11:
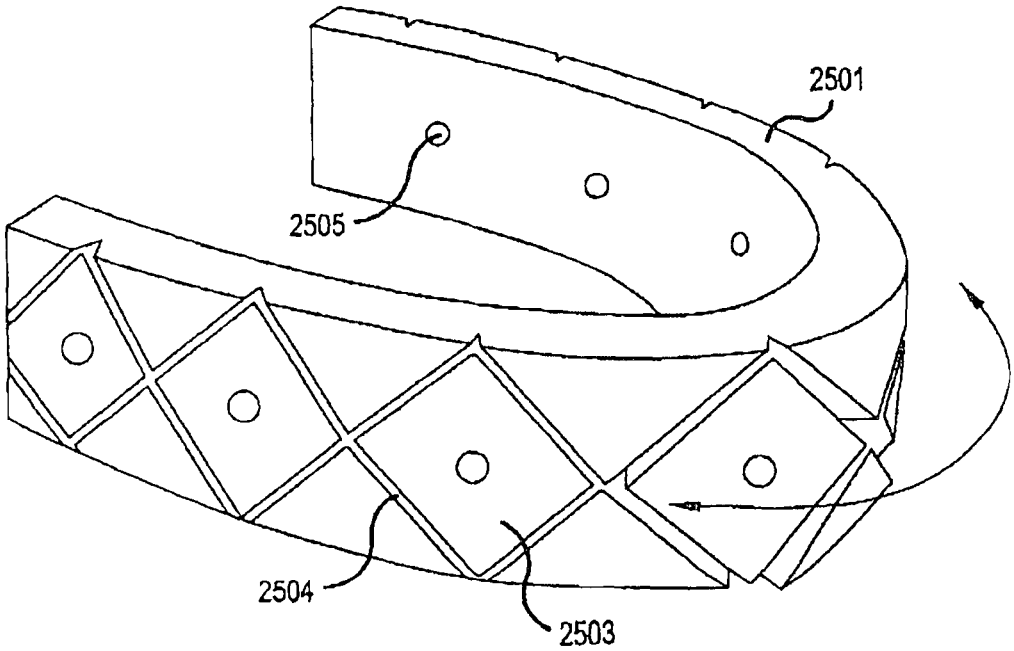
FIG. 11 is a view illustrating the flexible of side pad member illustrated in FIG. 10.
Figure 12:
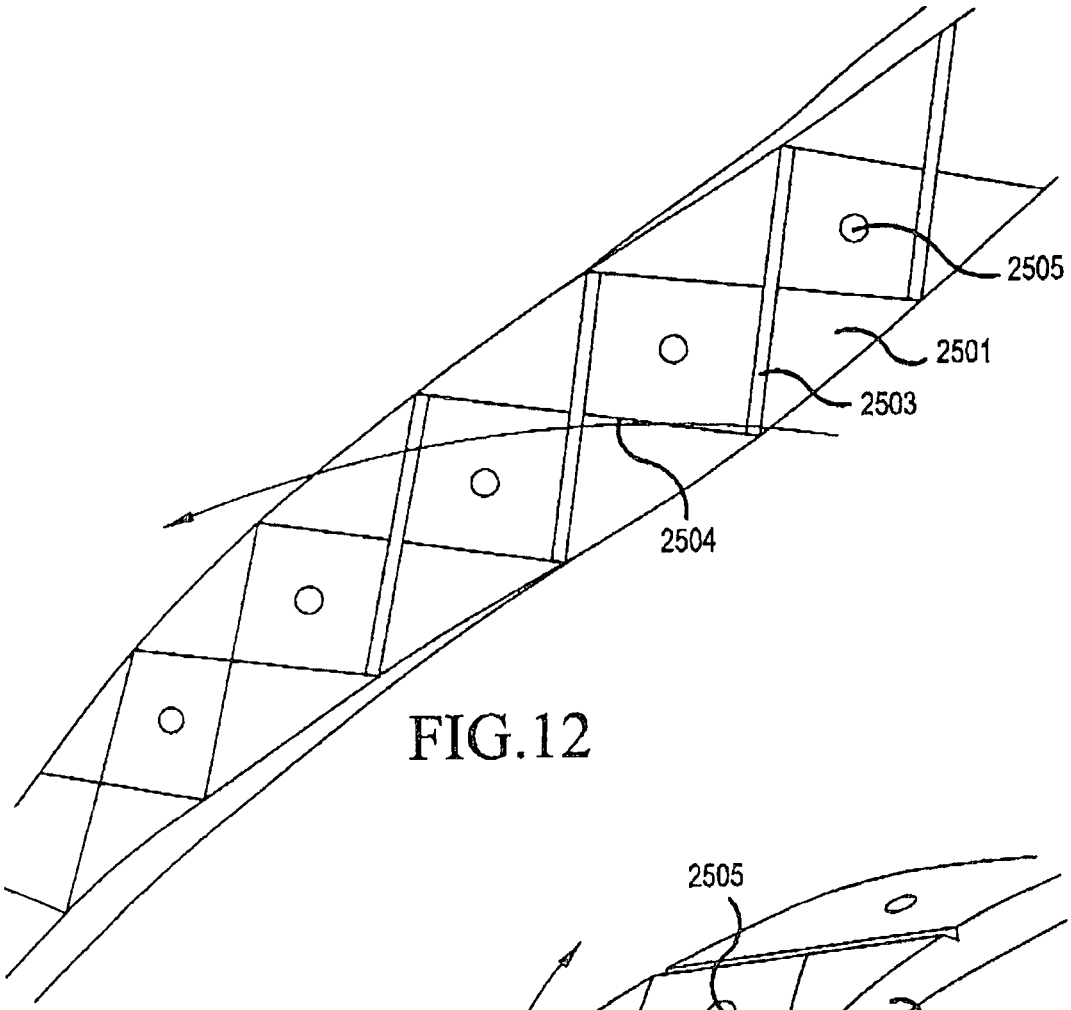
FIG. 12 is a view illustrating the flexible of side pad member illustrated in FIG. 10.
Figure 13:
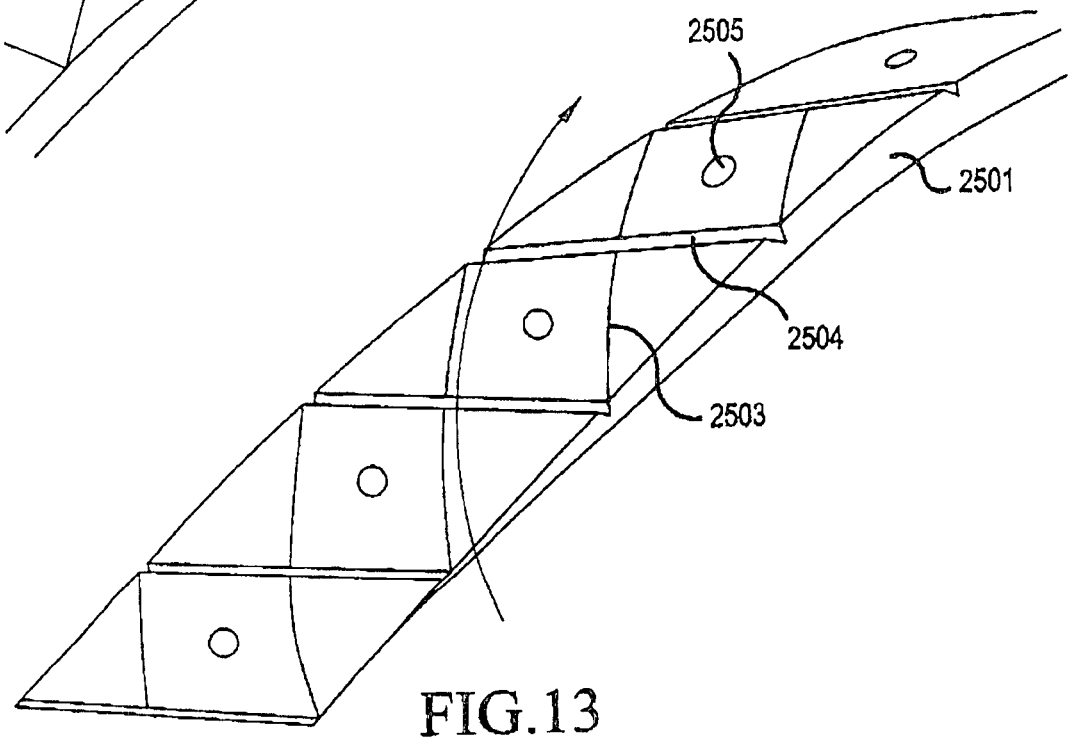
FIG. 13 is a view illustrating the flexible of side pad member illustrated in FIG. 10.

FIGS. 11 to 13 are views illustrating the flexibility of pad 2501 illustrated in FIG. 10 to wherein it is clear that the flexible pad 2501 may be flexed in many directions. An adjustable left securing member is secured to an outer side of the plurality of outer and inner left front side pad members and an outer side of the plurality of outer and inner left rear side pad members and an adjustable right securing member secured to an outer side of the plurality of outer and inner right front side pad members and an outer side of the plurality of outer and inner right rear side pad members for adjustably securing the plurality of left and right, front and rear, outer and inner side pad members relative to each other.

Figure 14:
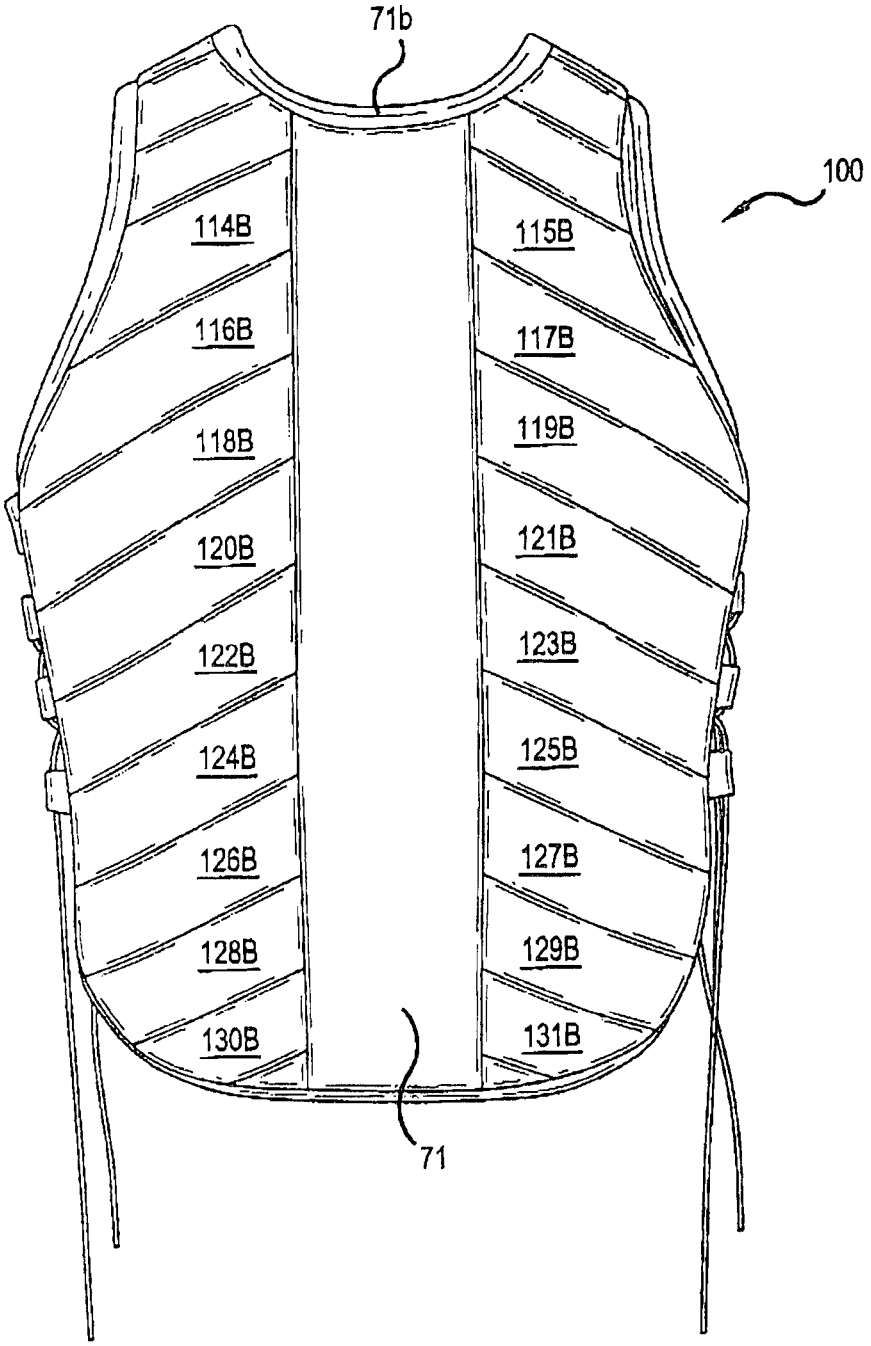
FIG. 14 is a view illustrating another embodiment of the present invention with a torsion-flex spinal pad provided on the rear of the body protector.
Figure 15:
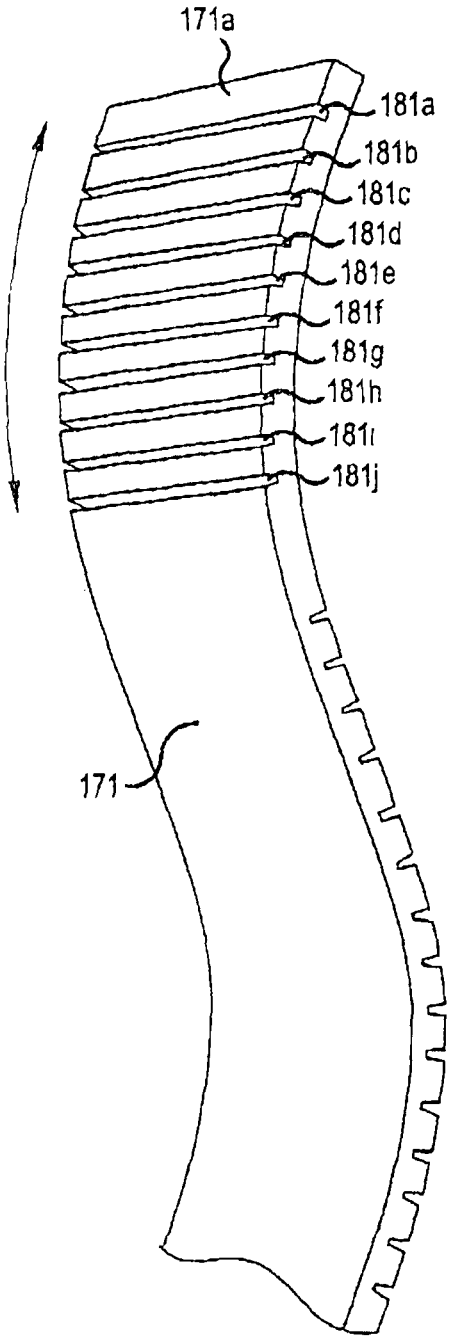
FIG. 15 is a view illustrating the one side of the torsion-flex spinal pad for the body protector that is centrally positioned in the embodiment illustrated in FIG. 15.
Figure 16:
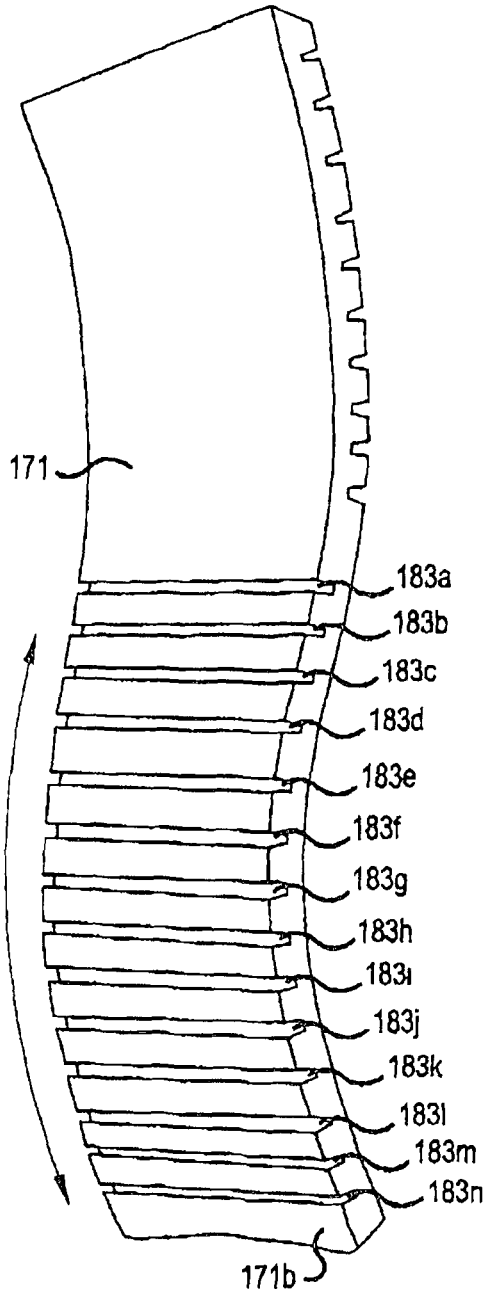
FIG. 16 is a view illustrating the another side of the torsion-flex spinal pad for the body protector that is centrally positioned in the embodiment illustrated in FIG. 15.

As illustrated in FIGS. 14-16, another embodiment of the present invention is set forth that includes a torsion-flex spinal pad 71. A body protector 100 includes a plurality of outer left and right front side pad members (not illustrated in FIG. 14) with a flexible break being formed between adjacent outer left and right front side pad members. A plurality of inner left and right front side pad members is disposed behind said plurality of outer left and right front side pad members for overlapping the respective flexible breaks formed in the plurality of outer left and right front side pad members. In addition, a plurality of outer left and right rear side pad members 114B-130B and 115B-131B is provided with a flexible break being formed between adjacent outer left and right rear side pad members 114B-130B and 115B-131B. A plurality of inner left and right rear side pad members is disposed behind said plurality of outer left rear side pad members for overlapping the respective flexible breaks formed in the plurality of outer left and right rear side pad members. A torsion-flex spinal pad 71 extends from an upper portion adjacent to a neck 71*b* of a user to a lower portion of the body protector 100 with the plurality of outer and inner left rear side pad members being secured to a left side of the torsion-flex spinal pad 71 and the plurality of inner and outer right rear side pad members being secured to a right side of the torsion-flex spinal pad 71.

Figure 22:
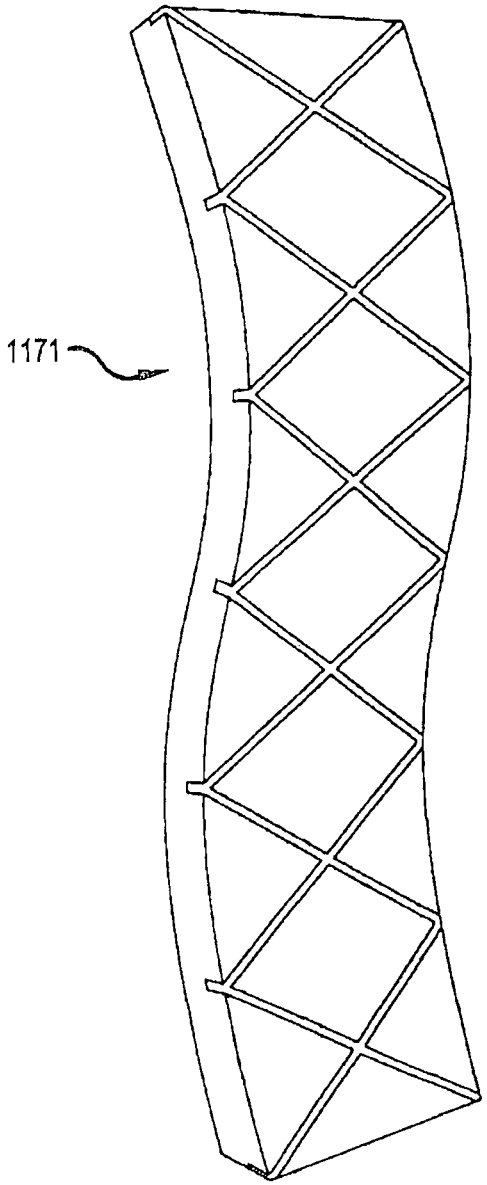
FIG. 22 is a side view of the torsion-flex spinal pad with a crisscross groove.
Figure 23:
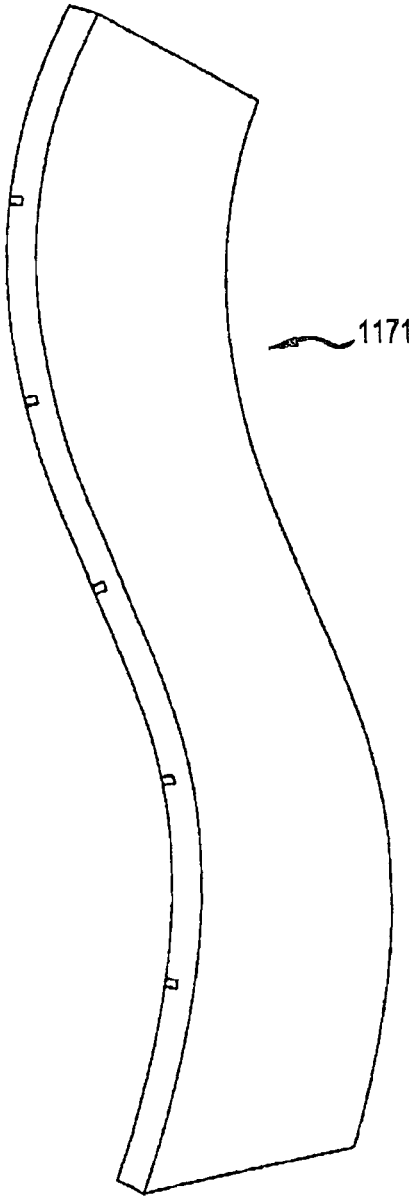
FIG. 23 is a side view of the torsion-flex spinal pad with a smooth surface.
Figure 27:
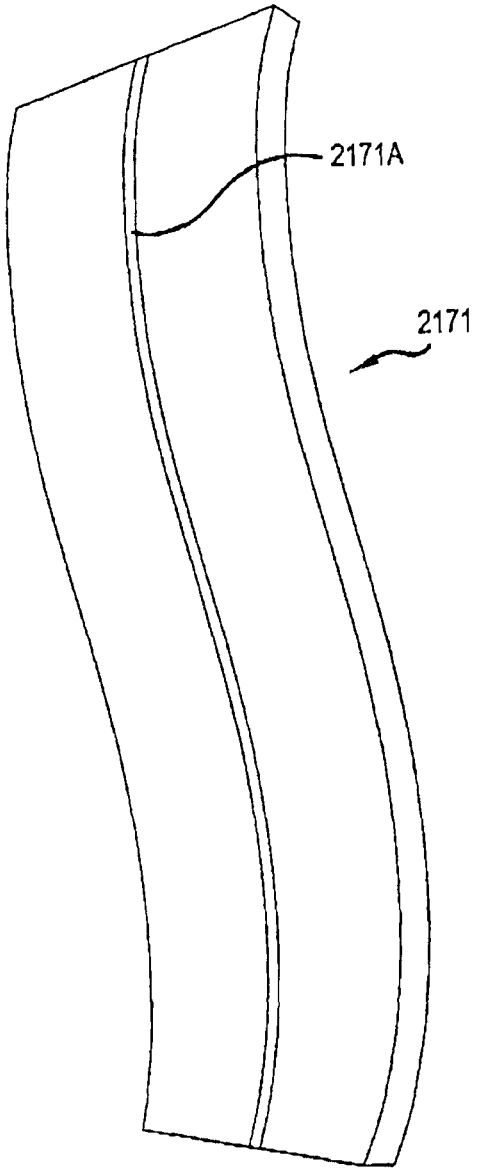
FIG. 27 is a side view of one side of a torsion-flex spinal pad with a longitudinal groove in on outer surface.
Figure 28:
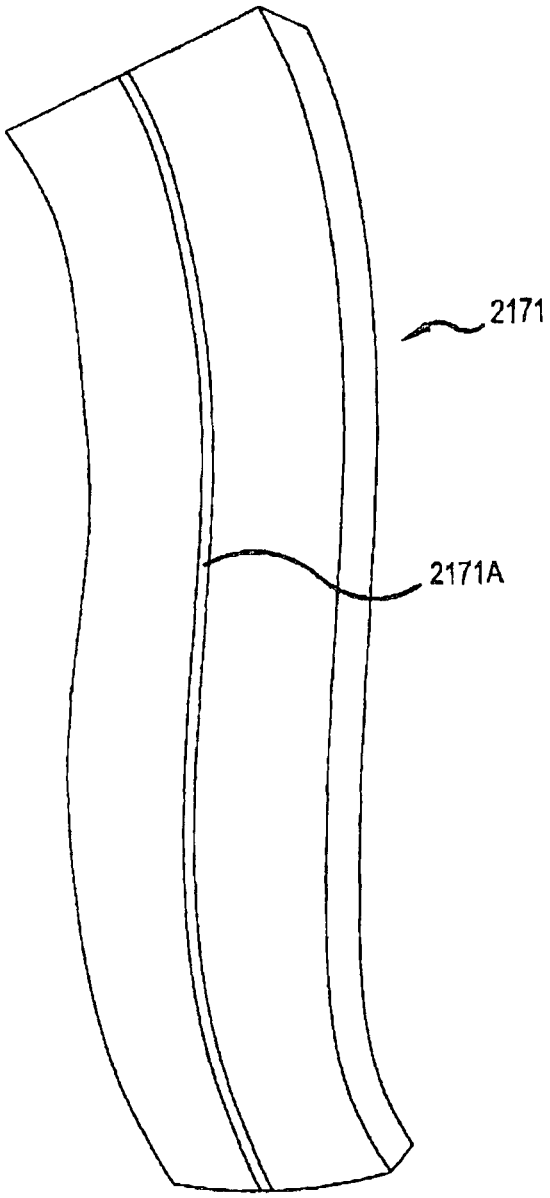
FIG. 28 is a side view of the other side of the torsion-flex spinal pad illustrated in FIG. 27 with a longitudinal groove in an outer surface.

FIG. 15 is a view illustrating one side of the torsion-flex spinal pad 171 for the body protector 100. The torsion-flex spinal pad 171 includes a plurality of horizontal grooves 181*a* to 181*j* arranged at an upper portion 171*a* thereof. The torsion-flex spinal pad 171 may be a solid member that is flat with no grooves or may include grooves on the outer surface thereof. In addition, as illustrated in FIGS. 22 and 23, the torsion-flex spinal pad 1171 may have a crisscross groove disposed on one or both of the outer surfaces. Further, as illustrated in FIGS. 27 and 28, the torsion-flex spinal pad 2171 may have a groove 2171A disposed longitudinally along the length of the torsion-flex spinal pad 2171. The groove 2171A may be on one side or on both of the outer surfaces.

FIG. 16 is a view illustrating the other side of the torsion-flex spinal pad 171 for the body protector 100. The torsion-flex spinal pad 171 includes a plurality of horizontal grooves 183*a* to 183*n* arranged at a lower portion 171*b* thereof.

Torsion-flex spinal pads 71, 171 are designed to provide protective coverage while mimicking the natural movement of an individual's body. A double layer of torsion-flex spinal pads increase spinal protection without adding bulk or restriction to movement. The torsion-flex padding system amplifies the fit and natural movement of the body, forms better, fits better and has better flexibility.

Figure 17:
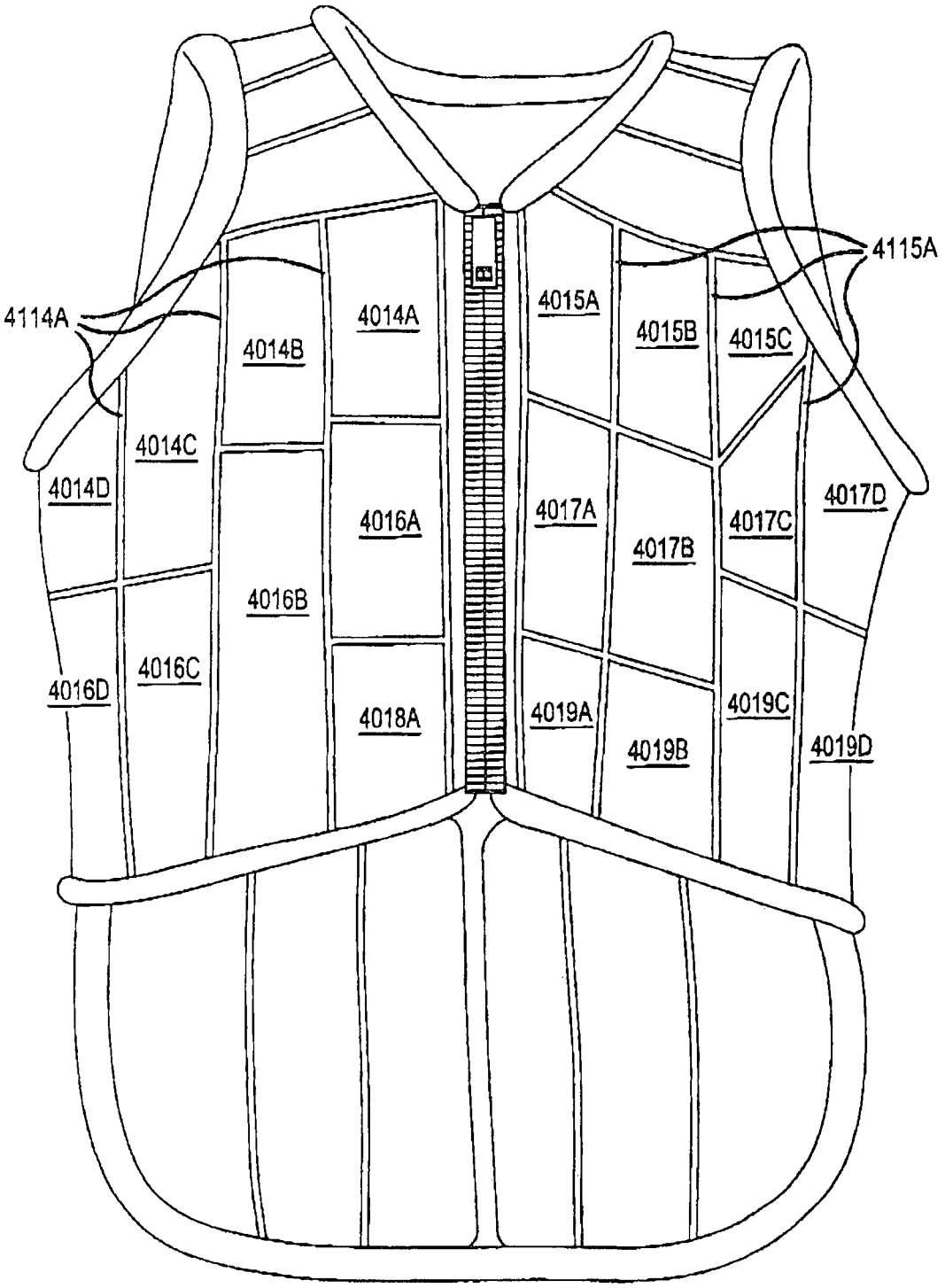
FIG. 17 is front elevational view illustrating the body protector according to the an embodiment of the present invention wherein the pad members are vertically arranged.

As illustrated in FIG. 17, the plurality of outer left and right front pad members 4014A-4014D, 4016A-4016D and 4018A may be arranged to be substantially vertical relative to each other with the plurality of inner left and right inner front pad members being arranged to be substantially vertical relative to each other with the plurality of inner left and right front pad members being displaced a predetermined distance relative to the plurality of outer left and right front pad members to enable an overlapping of the foam material forming the plurality of inner left and right front pad members 4014A-4014D, 4016A-4016D and 4018A with the flexible breaks 4114X, 4115X formed between adjacent pad members of respective outer left and right front pad members 4014A-4014D, 4016A-4016D and 4018A for eliminating penetration through the flexible breaks 4114X, 4115X.

Figure 18:
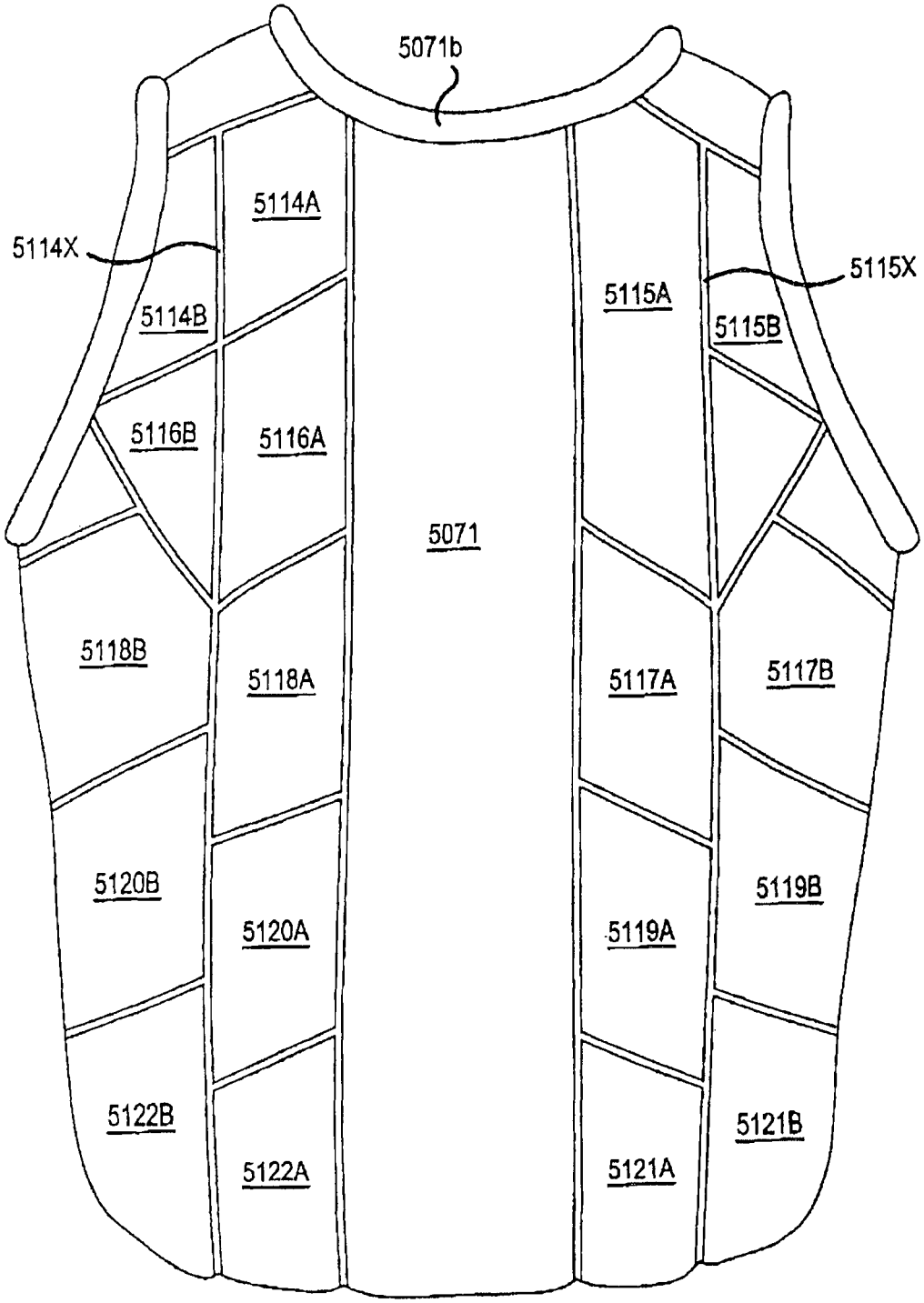
FIG. 18 is rear elevational view illustrating the body protector according to the an embodiment of the present invention wherein the pad members are vertically arranged.

As illustrated in FIG. 18, the plurality of outer left and right rear pad members 5114A, 5114B, 5116A, 5116B, 5118A, 5118B, 5120A, 5120B, 5122A, 5122B and 5115A, 5115B, 5117A, 5117B, 5119A, 5119B, 5121A, 5121 may be arranged to be substantially vertical relative to each other and said plurality of inner left and right inner rear pad members being arranged to be substantially vertical relative to each other with the plurality of inner left and right rear pad members being displaced a predetermined distance relative to the plurality of outer left and right rear pad members 5114A, 5114B, 5116A, 5116B, 5118A, 5118B, 5120A, 5120B, 5122A, 5122B and 5115A, 5115B, 5117A, 5117B, 5119A, 5119B, 5121A, 5121 to enable an overlapping of the foam material forming the plurality of inner left and right rear pad members with the flexible breaks 5114X, 5115X formed between adjacent pad members of respective outer left and right rear pad members 5114A, 5114B, 5116A, 5116B, 5118A, 5118B, 5120A, 5120B, 5122A, 5122B and

5115A, 5115B, 5117A, 5117B, 5119A, 5119B, 5121A, 5121 for eliminating penetration through the flexible break.

Figure 19:
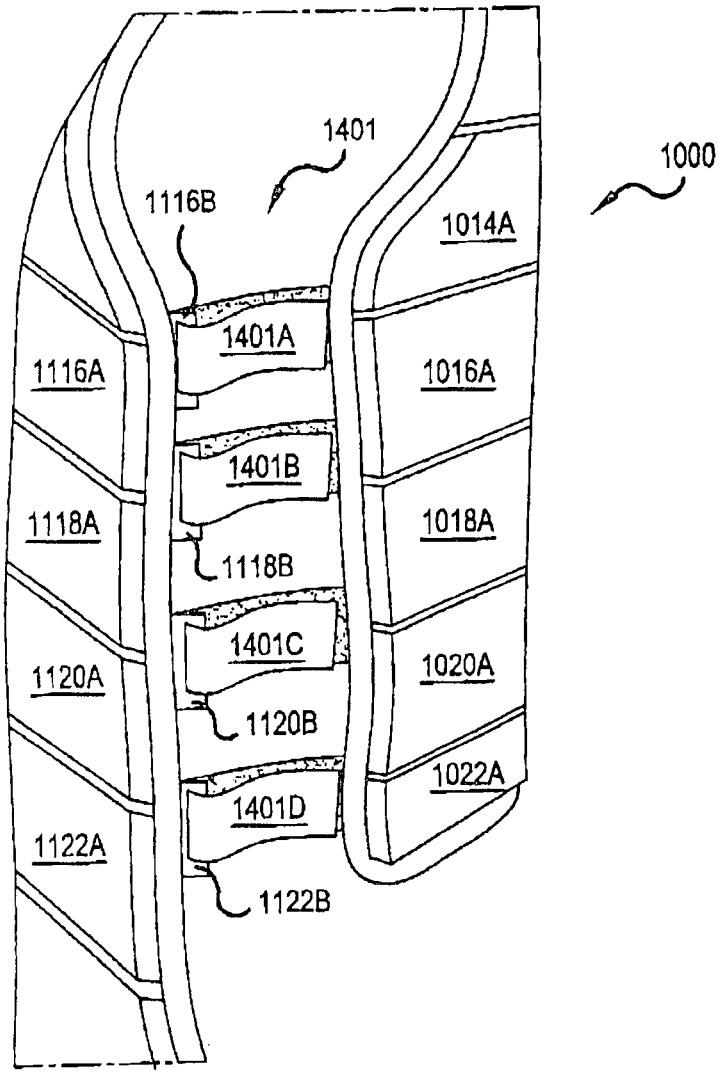
FIG. 19 is a side perspective view illustrating the body protector according to the present invention with a hook and loop live-fit adjustment securing member for attaching the side portions of the body protector.

FIG. 19 is a side perspective view illustrating the body protector 1000. A live-fit adjustment system or adjustable left securing member 1401 may consist of hook and loop connectors 1401A-1401D connector. One end of the hook and loop connectors 1401A-1401D is connected to an outer left front side pad members 1014A-1022A with fasteners 1116B-1122B attached to the outer left rear side pad members 1116A-1122A for securing the side portions of the body protector 1000.

Figure 20:
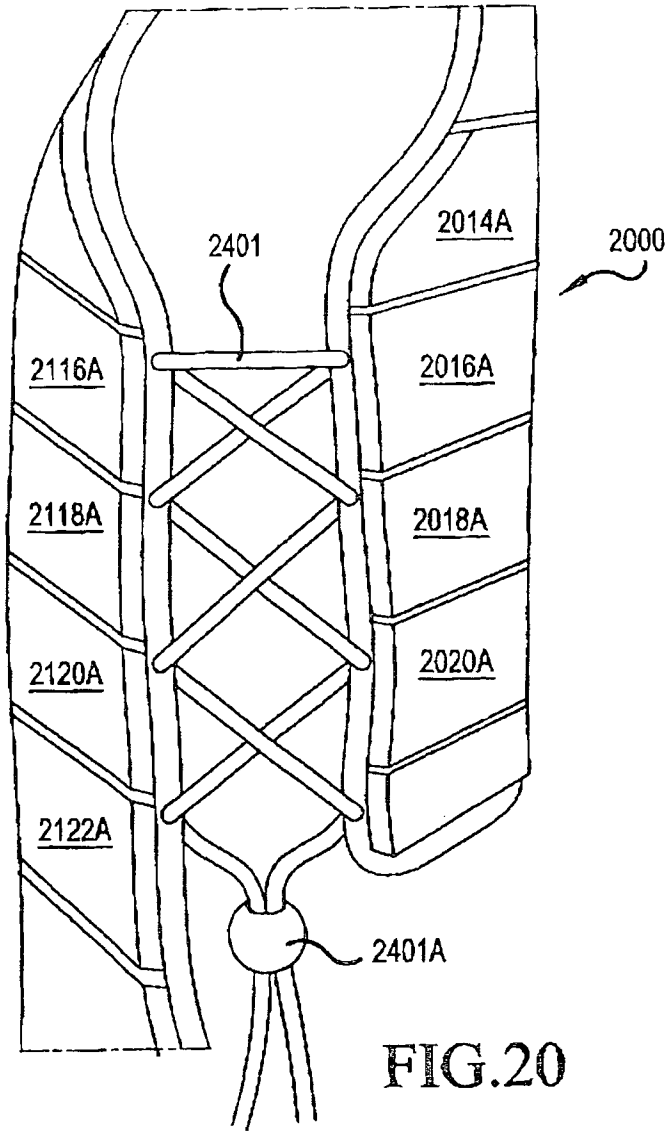
FIG. 20 is a side perspective view illustrating the body protector according to the present invention with a lace and cord provided for the live-fit adjustment securing member for attaching the side portions of the body protector.

FIG. 20 is a side perspective view illustrating the body protector 2000. A live-fit adjustment system or adjustable left securing member 2401 may consist of a cord laced through openings in an outer left front side pad members 2014A-2020A and the outer left rear side pad members 2116A-2122A with a fastener 2401A attached to the live-fit adjustment system or adjustable left securing member 2401 for securing the side portions of the body protector 2000.

Figure 21:
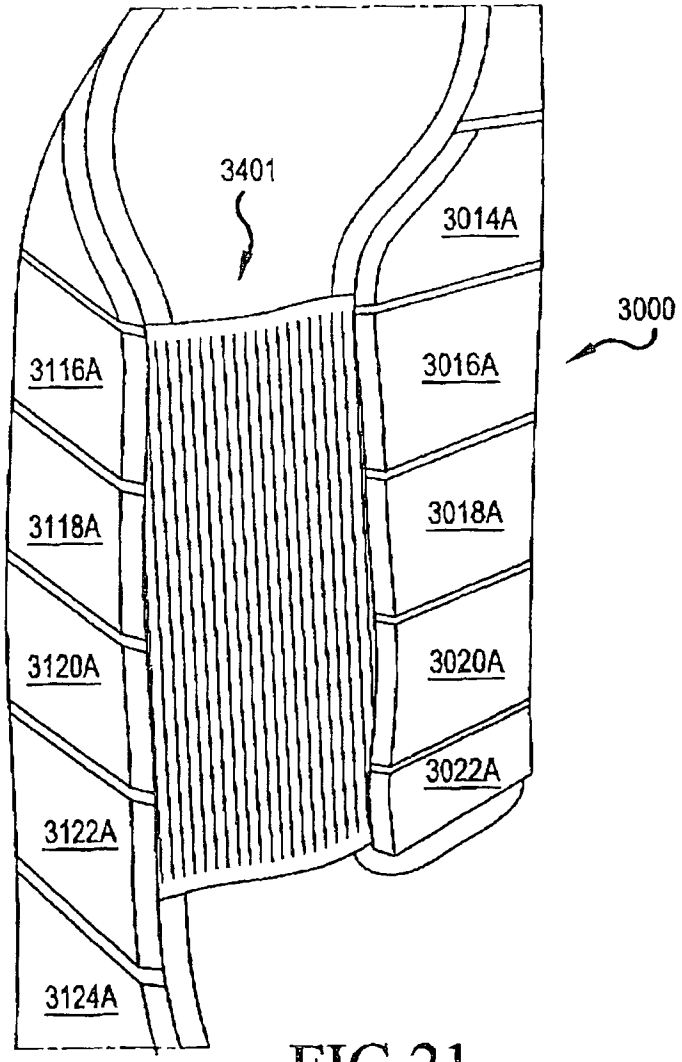
FIG. 21 is a side perspective view illustrating the body protector according to the present invention with an elastic member for the live-fit adjustment securing member for attaching the side portions of the body protector.

FIG. 21 is a side perspective view illustrating the body protector 3000. A live-fit adjustment system or adjustable left securing member 3401 may consist of an elastic stretch side closure attached to an outer left front side pad members 3014A-3022A and the outer left rear side pad members 3116A-3124A for securing the side portions of the body protector 3000.

Figure 24:
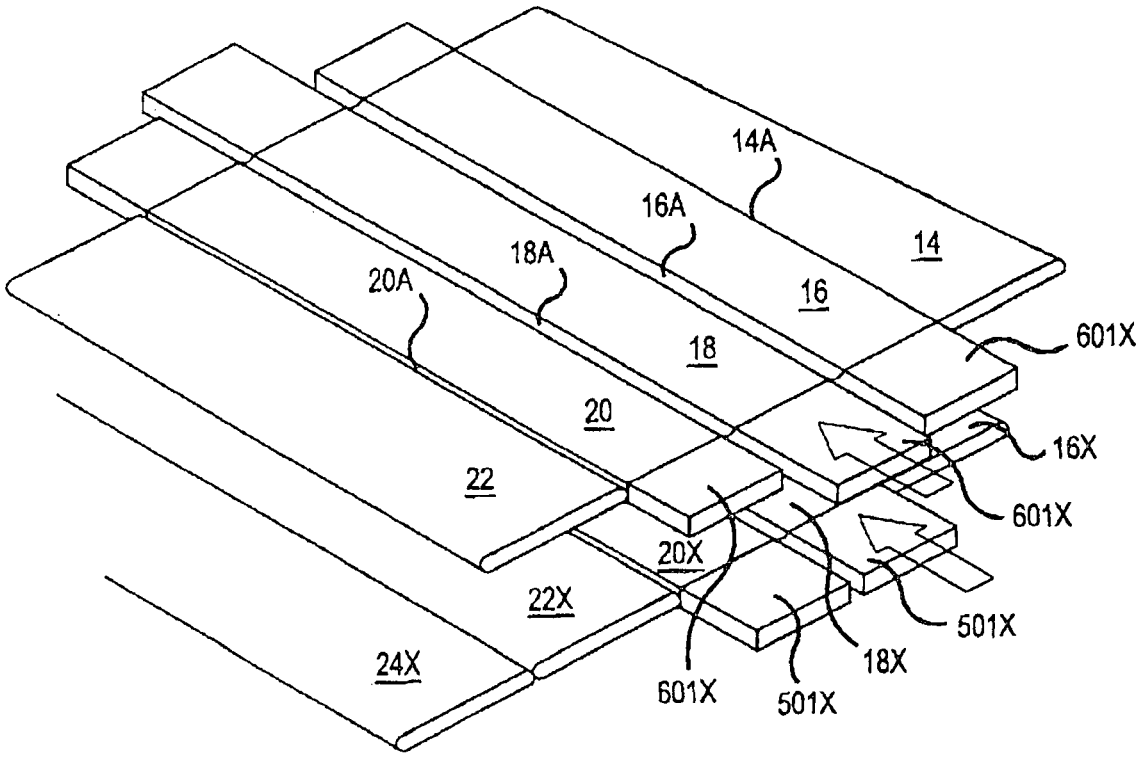
FIG. 24 is a view illustrating the pockets provided for securing the outer and inner pad members in an overlapping arrangement.
Figure 25:
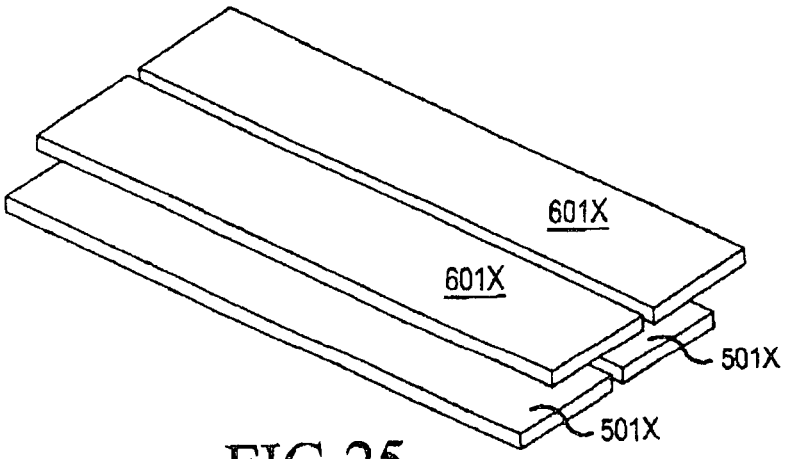
FIG. 25 is a view illustrating the layering of outer and inner side pad members with smooth outer surfaces.

FIG. 24 illustrates how the outer left front side pad members 14-22 include pockets for receiving the foam pads 601X and how the inner left front side pad members 16X-24X are arranged to be offset a predetermined distance relative to the outer left front side pad members 14-22 to permit the flexible breaks 14A-20A to be covered to eliminating penetration through the flexible breaks 14A-20A. The pockets are formed by an outer cover and an inner cover being directly connected to one another to form a flexible break. Each pocket receives a pad member, which are separated from another by a flexible break. FIG. 25 illustrates the overlap arrangement of the pads 501X and 601X relative to each other.

Figure 26:
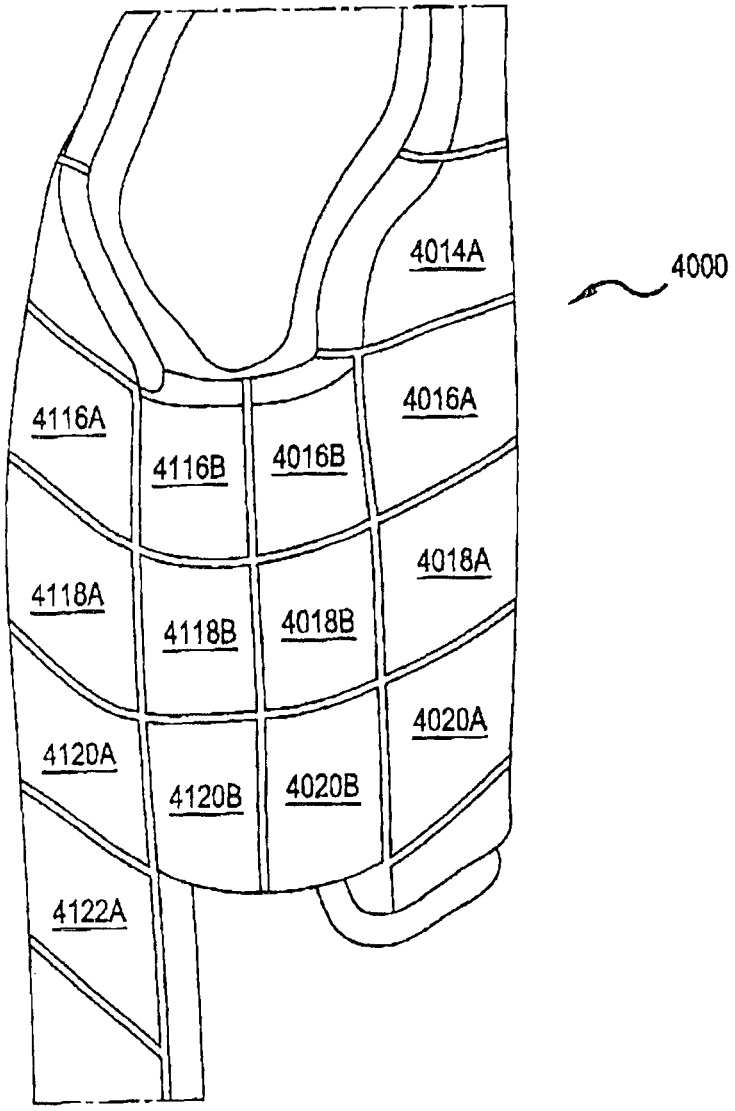
FIG. 26 is a side perspective view illustrating the body protector according to the present invention with a full wrap around padding.

FIG. 26 is a side perspective view illustrating the body protector 4000. In this embodiment the body protector includes outer left front side pad members 4014A-4020A and the outer left rear side pad members 4116A-4122A. The outer left front side pad members 4014A-4020A and the outer left rear side pad members 4116A-4122A are secured directly to each other by outer left front side pad members 4016B-4020B and outer left rear side pad members 4116B-4120B for securing the side portions of the body protector 3000.

Figure 29:
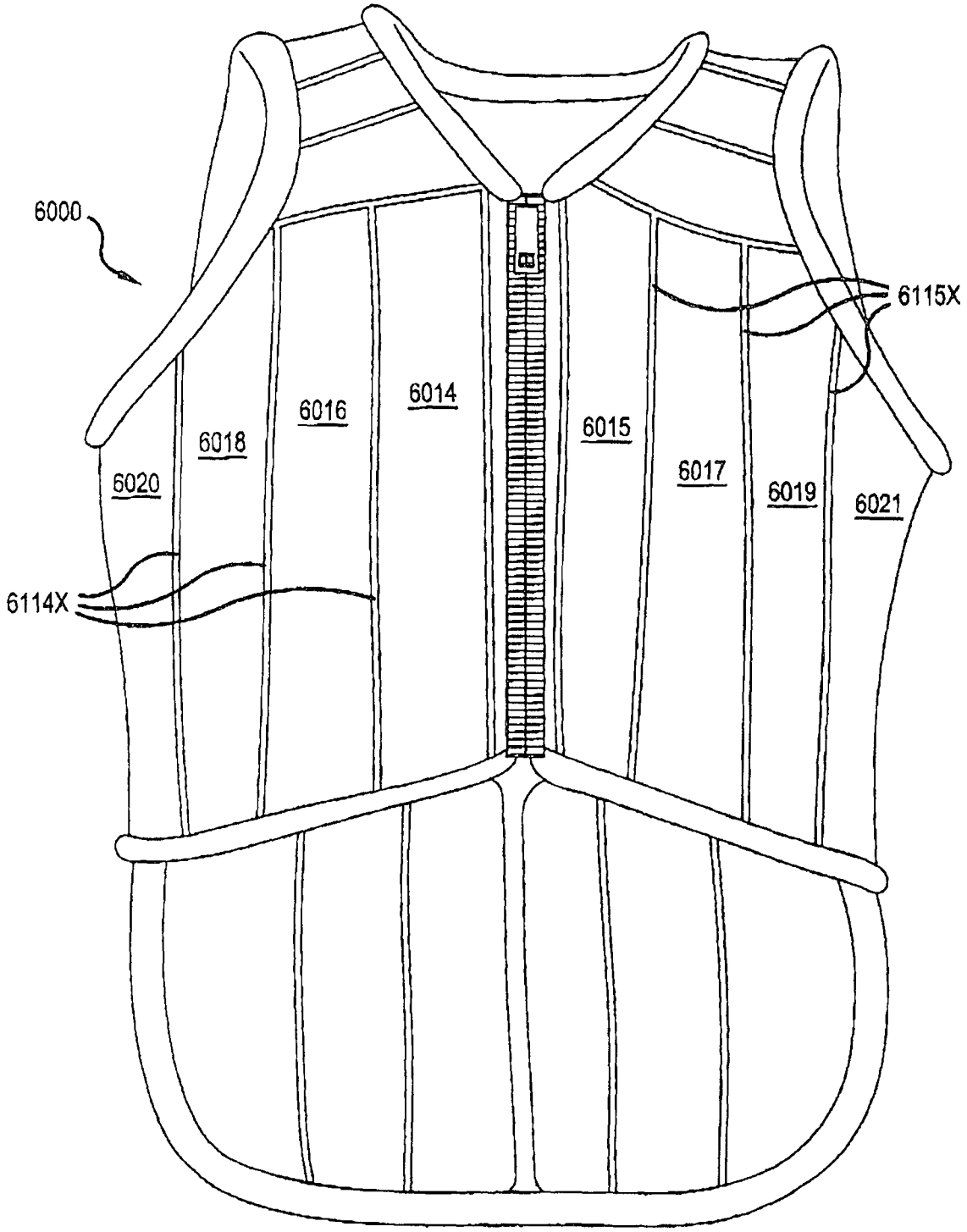
FIG. 29 is front elevational view illustrating the body protector according to the another embodiment of the present invention wherein the pad members are vertically arranged.

As illustrated in FIG. 29, the body protector 6000 includes a plurality of outer left and right front pad members 6014-6020 and 6015-6021 arranged to be substantially vertical relative to each other with the plurality of inner left and right inner front pad members being arranged to be substantially vertical relative to each other with the plurality of inner left and right front pad members being displaced a predetermined distance relative to the plurality of outer left and right front pad members to enable an overlapping of the foam material forming the plurality of inner left and right front pad members 6014-6020 and 6015-6021 with the flexible breaks 6114X, 6115X formed between adjacent pad members of respective outer left and right front pad members 6014-6020 and 6015-6021 for eliminating penetration through the flexible breaks 6114X, 6115X.

Figure 30:
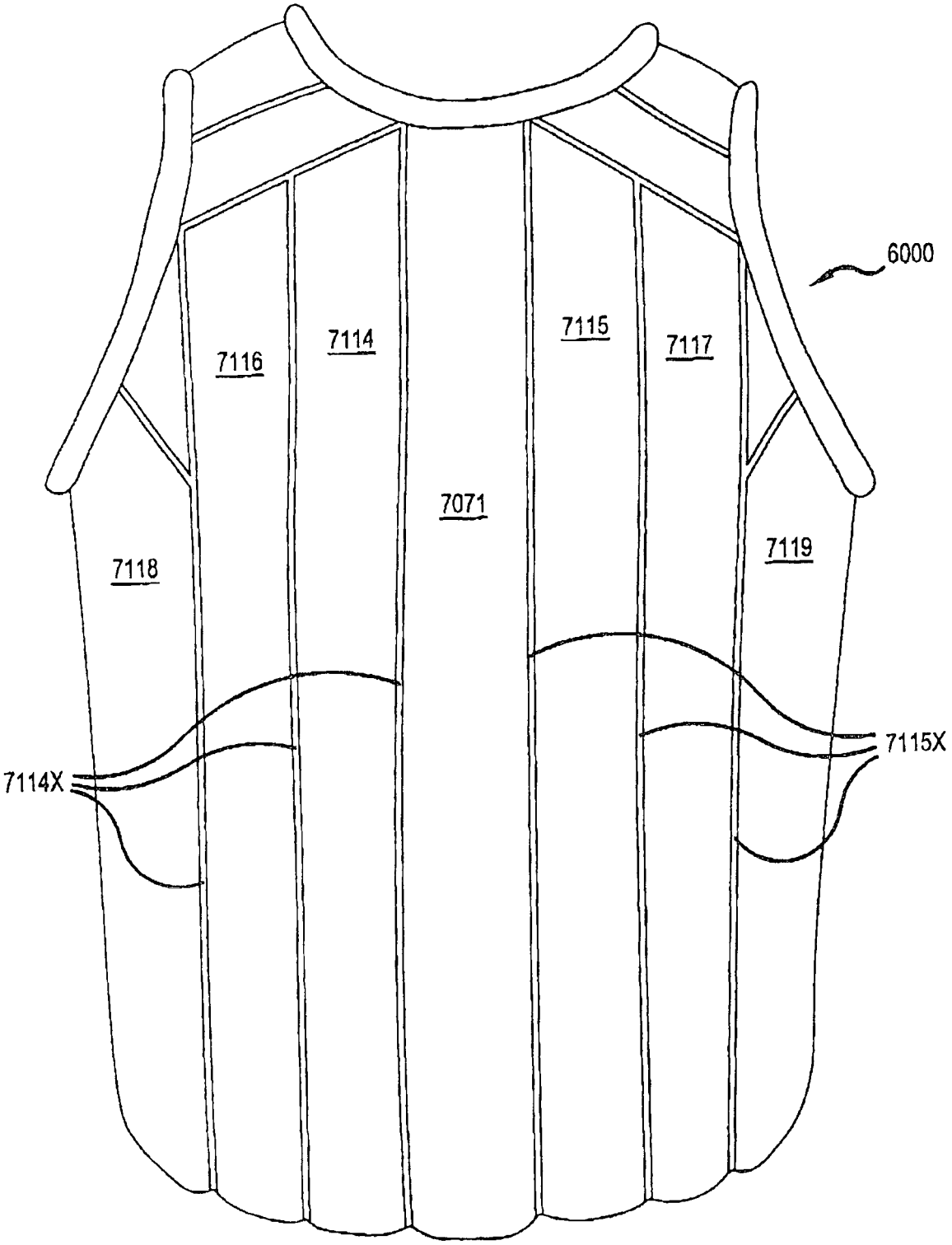
FIG. 30 is rear elevational view illustrating the body protector according to the another embodiment of the present invention wherein the pad members are vertically arranged.

As illustrated in FIG. 30, the body protector 6000 includes a torsion flex spine 7071 with a plurality of outer left and right rear pad members 7114-7018 and 7015-7019 arranged to be substantially vertical relative to each other and said plurality of inner left and right inner rear pad members being arranged to be substantially vertical relative to each other with the plurality of inner left and right rear pad members being displaced a predetermined distance relative to the plurality of outer left and right rear pad members 7114-7018 and 7015-7019 to enable an overlapping of the foam material forming the plurality of inner left and right rear pad members with the flexible breaks 7114X, 7115X formed between adjacent pad members of respective outer left and right rear pad members 7114-7018 and 7015-7019 for eliminating penetration through the flexible breaks 7114X, 7115X.

The double layered padding construction with each padding layer moving independently increases the impact protection and eliminates possible penetration.

The vertical live contour-fit lines are designed into both the front and back of the body protector, to provide an improved natural body-fit.

The present invention provides a unique different in the fit as compared to prior body protectors.

The angular padding construction and the vertical-angled flex bar breaks improve the body fit and increase the flex, the function of the body protector.

The side closure of the body protector includes a flex tab system to enable the front and back assemblies of the body protector to expand and contract with the movements of the body. This arrangement also improves the fit and function of the body protector when worn.

The padding system includes layers of padding to improve the protection by stopping any penetration through body protector padding seams. The padding system provides overlapping layers that move over each other to increase the overall flexibility to improve the contoured fit and function of the body protector The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A body protector comprising:

a plurality of outer left front side pad members, each pad member having a pocket retaining a foam member, the pocket formed between an inner cover and an outer cover which are joined together to form a flexible break between adjacent foam members, side edges of the adjacent foam members being spaced from one another by the flexible break;

a plurality of inner left front side pad members disposed behind said plurality of outer left front side pad members for overlapping the respective flexible breaks formed between the foam members of the plurality of outer left front side pad members, each pad member having a pocket retaining a foam member;

a plurality of outer right front side pad members, each pad member having a pocket retaining a foam member, the pocket formed between an inner cover and an outer cover which are joined together to form a flexible break between adjacent foam members, side edges of the adjacent foam members being spaced from one another by the flexible break;

a plurality of inner right front side pad members disposed behind said plurality of outer right front side pad members for overlapping the respective flexible breaks formed between the foam members of the plurality of outer right front side pad members, each pad member having a pocket retaining a foam member;

a plurality of outer left rear side pad members, each pad member having a pocket retaining a foam member, the pocket formed between an inner cover and an outer cover which are joined together to form a flexible break between adjacent foam members, side edges of the adjacent foam members being spaced from one another by the flexible break;

a plurality of inner left rear side pad members disposed behind said plurality of outer left rear side pad members for overlapping the respective flexible breaks formed between the foam members of the plurality of outer left rear side pad members, each pad member having a pocket retaining a foam member;

a plurality of outer right rear side pad members, each pad member having a pocket retaining a foam member, the pocket formed between an inner cover and an outer cover which are joined together to form a flexible break between adjacent foam members, side edges of the adjacent foam members being spaced from one another by the flexible break; and a plurality of inner right rear side pad members disposed behind said plurality of outer right rear side pad members for overlapping the respective flexible breaks formed between the foam members of the plurality of outer right rear side pad members, each pad member having a pocket retaining a foam member.

2. The body protector according to claim 1, wherein each of the plurality of outer and inner, left and right, front and rear side pad members is formed of a foam material.

3. The body protector according to claim 2, wherein the plurality of outer left and right front pad members is arranged at an incline relative to each other and said plurality of inner left and right inner front pad members is arranged at substantially the same incline relative to each other with said plurality of inner left and right front pad members being displaced a predetermined distance relative to the plurality of outer left and right front pad members to enable an overlapping of the foam material forming the plurality of inner left and right front pad members with the flexible break formed between adjacent pad members of respective outer left and right front pad members for eliminating penetration through the flexible break.

4. The body protector according to claim 2, wherein the plurality of outer left and right rear pad members is arranged at an incline relative to each other and said plurality of inner left and right inner rear pad members is arranged at substantially the same incline relative to each other with said plurality of inner left and right rear pad members being displaced a predetermined distance relative to the plurality of outer left and right rear pad members to enable an overlapping of the foam material forming the plurality of inner left and right rear pad members with the flexible break formed between adjacent pad members of respective outer left and right rear pad members for eliminating penetration through the flexible break.

5. The body protector according to claim 2, wherein the plurality of outer left and right front pad members is arranged to be substantially horizontal relative to each other and said plurality of inner left and right inner front pad members is arranged to be substantially horizontal relative to each other with said plurality of inner left and right front pad members being displaced a predetermined distance relative to the plurality of outer left and right front pad members to enable an overlapping of the foam material forming the plurality of inner left and right front pad members with the flexible break formed between adjacent pad members of respective outer left and right front pad members for eliminating penetration through the flexible break.

6. The body protector according to claim 2, wherein the plurality of outer left and right rear pad members is arranged to be substantially horizontal relative to each other and said plurality of inner left and right inner rear pad members is arranged to be substantially horizontal relative to each other with said plurality of inner left and right rear pad members being displaced a predetermined distance relative to the plurality of outer left and right rear pad members to enable an overlapping of the foam material forming the plurality of inner left and right rear pad members with the flexible break formed between adjacent pad members of respective outer left and right rear pad members for eliminating penetration through the flexible break.

7. The body protector according to claim 2, wherein the plurality of outer left and right front pad members is arranged to be substantially vertical relative to each other and said plurality of inner left and right inner front pad members is arranged to be substantially vertical relative to each other with said plurality of inner left and right front pad members being displaced a predetermined distance relative to the plurality of outer left and right front pad members to enable an overlapping of the foam material forming the plurality of inner left and right front pad members with the flexible break formed between adjacent pad members of respective outer left and right front pad members for eliminating penetration through the flexible break.

8. The body protector according to claim 2, wherein the plurality of outer left and right rear pad members is arranged to be substantially vertical relative to each other and said plurality of inner left and right inner rear pad members is arranged to be substantially vertical relative to each other with said plurality of inner left and right rear pad members being displaced a predetermined distance relative to the plurality of outer left and right rear pad members to enable an overlapping of the foam material forming the plurality of inner left and right rear pad members with the flexible break formed between adjacent pad members of respective outer left and right rear pad members for eliminating penetration through the flexible break.

9. The body protector according to claim 1, and further including an attaching members for releasably securing the plurality of left front outer and inner side pad members to said plurality of right front outer and inner side pad members.

10. The body protector according to claim 1, and further including an adjustable left securing member secured to an outer side of the plurality of outer and inner left front side pad members and an outer side of the plurality of outer and inner left rear side pad members and an adjustable right securing member secured to an outer side of the plurality of outer and inner right front side pad members and an outer side of the plurality of outer and inner right rear side pad members for adjustably securing the plurality of left and right, front and rear, outer and inner side pad members relative to each other.

11. The body protector according to claim 1, further comprising:

a torsion-flex spinal pad extending from an upper portion adjacent to a neck of a user to a lower portion of said body protector, said plurality of outer and inner left rear side pad members being secured to a left side of the torsion-flex spinal pad and the plurality of inner and outer right rear side pad members being secured to a right side of the torsion-flex spinal pad.

12. The body protector according to claim 11, further comprising grooves formed in a front side and a rear side of the spinal pad.

13. The body protector according to claim 1, wherein the outer left front side pad members are movable relative to the inner left front side pad members.

14. The body protector according to claim 13, wherein the outer right front side pad members are movable relative to the inner right front side pad members.

15. The body protector according to claim 1, wherein the outer left rear side pad members are movable relative to the inner left rear side pad members.

16. The body protector according to claim 15, wherein the outer right rear side pad members are movable relative to the inner right rear side pad members.

17. The body protector according to claim 1, further comprising diagonal grooves extending across a width of the foam members.

18. The body protector according to claim 17, further comprising apertures formed in the foam members, the apertures formed between edges of the foam members.

19. The body protector according to claim 1, wherein adjacent foam members are movable relative to one another.

20. The body protector according to claim 1, wherein the flexible breaks are formed by the outer cover and the inner cover being directly connected to one another.

* * * * *